US010439277B2

(12) United States Patent
Rao et al.

(10) Patent No.: US 10,439,277 B2
(45) Date of Patent: Oct. 8, 2019

(54) CONFORMAL ELECTRO-TEXTILE ANTENNA AND ELECTRONIC BAND GAP GROUND PLANE FOR SUPPRESSION OF BACK RADIATION FROM GPS ANTENNAS MOUNTED ON AIRCRAFT

(71) Applicant: The MITRE Corporation, McLean, VA (US)

(72) Inventors: Basrur Rama Rao, Lexington, MA (US); Eddie Nelson Rosario, Methuen, MA (US)

(73) Assignee: The MITRE Corporation, McLean, VA (US)

( * ) Notice: Subject to any disclaimer, the term of this patent is extended or adjusted under 35 U.S.C. 154(b) by 0 days.

(21) Appl. No.: 16/114,740

(22) Filed: Aug. 28, 2018

(65) Prior Publication Data

US 2019/0067807 A1 Feb. 28, 2019

Related U.S. Application Data

(62) Division of application No. 13/552,890, filed on Jul. 19, 2012, now Pat. No. 10,141,638.

(51) Int. Cl.

| | |
|---|---|
| ***H01Q 1/48*** | (2006.01) |
| ***H01Q 1/28*** | (2006.01) |
| ***H01Q 9/04*** | (2006.01) |
| ***H01Q 15/00*** | (2006.01) |

(52) U.S. Cl.

CPC ..... *H01Q 1/48* (2013.01); *H01Q 1/286* (2013.01); *H01Q 9/0464* (2013.01); *H01Q 15/006* (2013.01); *H01Q 15/0086* (2013.01)

(58) Field of Classification Search

CPC ..... H01Q 1/48; H01Q 15/006; H01Q 9/0464; H01Q 1/286; H01Q 15/0086

See application file for complete search history.

(56) References Cited

U.S. PATENT DOCUMENTS

| | | | | |
|---|---|---|---|---|
| 5,982,339 A * | 11/1999 | Lalezari | ..... | H01Q 1/521 343/705 |
| 6,274,293 B1 * | 8/2001 | Gupta | ..... | B82Y 20/00 427/124 |
| 7,190,315 B2 * | 3/2007 | Waltho | ..... | H01Q 1/28 343/705 |

(Continued)

OTHER PUBLICATIONS

Zaghloul, A Concept for a Broadband Electromagnetic Band Gap Structure, Proceedings of the 5th European Conference on Antennas and Propagation, Apr. 2011, pp. 383-387 (Year: 2011).*

*Primary Examiner* — Graham P Smith
*Assistant Examiner* — Jae K Kim
(74) *Attorney, Agent, or Firm* — Sterne, Kessler, Goldstein & Fox P.L.L.C.

(57) ABSTRACT

An antenna system having reduced back radiation is disclosed. The antenna system includes an antenna and ground plane. The antenna includes electro-textiles and is configured to operate in at least the frequency range between 1.1-1.6 GHz. The ground plane includes electro-textiles and is configured to operate as a frequency selective surface with electronic band gap characteristics to suppress edge and curved surface diffraction effects. In this system, the antenna and ground plane are configured to be located on a curved surface and to radiate with a directional radiation pattern having attenuated back lobes.

20 Claims, 24 Drawing Sheets

(56) References Cited

U.S. PATENT DOCUMENTS

| | | | | |
|---|---|---|---|---|
| 7,456,803 | B1 * | 11/2008 | Sievenpiper | H01Q 15/02 343/700 MS |
| 7,979,144 | B2 * | 7/2011 | Rajendran | B23K 26/032 700/61 |
| 9,450,304 | B1 * | 9/2016 | Edalati | H01Q 1/246 |
| 2004/0227682 | A1 * | 11/2004 | Anderson | G06K 7/0008 343/742 |
| 2006/0281382 | A1 * | 12/2006 | Karayianni | D03D 1/0088 442/181 |
| 2010/0039111 | A1 * | 2/2010 | Luekeke | G01R 33/341 324/318 |

* cited by examiner

1000

Top View of Step Resistivity Tapered E-Textile Ground Plane

CONFORMAL ELECTRO-TEXTILE ANTENNA AND ELECTRONIC BAND GAP GROUND PLANE FOR SUPPRESSION OF BACK RADIATION FROM GPS ANTENNAS MOUNTED ON AIRCRAFT

CROSS REFERENCE TO RELATED APPLICATION

This application is a divisional of U.S. Nonprovisional patent application Ser. No. 13/552,890, filed Jul. 19, 2012, titled "Conformal Electro-Textile Antenna and Electronic Band Gap Ground Plane for Suppression of Back Radiation From GPS Antennas Mounted on Aircraft," the contents of which are hereby incorporated herein by reference in its entirety.

BACKGROUND

Field of the Invention

This disclosure relates to antenna based systems and methods for aircraft navigation.

Background

Global Positioning System (GPS) antennas used for navigation on aircraft generate considerable backward radiation which is directed downwards towards the ground. This radiation is primarily caused by what is known as "creeping waves" generated by curved surface diffraction. A portion of the RF energy radiated by the GPS antenna is diffracted around the smooth cylindrical surface of the fuselage of the aircraft. This diffracted energy then propagates or "creeps" around the surface fuselage continuously shedding energy as it propagates until it dies out. It is this radiation that creates the back-lobes in the radiation pattern of the antenna that make these GPS antennas very vulnerable to interference from strong radiating sources located on the ground.

GPS antennas on aircraft can be either jammed or interfered with by a large number of sources. GPS signals are very weak due to their long travel distances from GPS satellites that are located 20,000 kilometers above the earth. Hence they encounter a large amount of "space loss" during their long travel distances. Ground based interference sources are relatively much closer to the GPS antennas on the aircraft and suffer much less path loss; hence they can easily overpower the GPS satellites signals and prevent them from being received.

Some of the antennas that create interfering signals originate from radiating sources located on the ground—the most likely scenario. Other signals can originate from antennas located on the aircraft itself, most likely on the lower surface of the aircraft. These antennas may operate at other frequencies on the aircraft and could be communications antennas, aeronautical radio navigation antennas, radar antennas etc. All of these antennas can be potential sources of RFI (Radio Frequency Interference).

Microstrip "patch" antennas are commonly used for building GPS antennas mounted on aircraft due to their low profile for reducing aerodynamic drag and their low cost and ease of manufacture. Microstrip antennae on aircraft are particularly prone to creating "creeping waves" since they use high dielectric constant substrates that can create creeping waves.

The Federal Aviation Administration (FAA) is currently relying on Global GPS navigation for all commercial aircraft flying in the U.S. These systems also go by the name GNSS (Global Navigation Satellite Systems). The GPS modernization program will soon require GPS antennas located on aircraft to receive the new $L_5$ signals operating between 1.164 GHz to 1.188 MHz with a center frequency at 1.176 GHz. This is in addition to the legacy $L_1$ signal operating at a center frequency of 1.5754 GHz (20 MHz bandwidth).

Since the new $L_5$ signal resides in the Aeronautical Radio Navigation Service (ARNS) band it is particularly susceptible to in-band interference from non GPS signals emitted by several U.S. navigation systems. Most prevalent are aircraft and ground based pulsed DME and TACAN beacons (1.025 to 1.150 GHz), JTIDS and MIDS (0.969 to 1.206 GHz), and ATC/ARNS interrogators, as well as harmonics of other VHF and UHF transmissions from communications antennas.

Several new types of broadband ground planes have recently been proposed to address these issues. These ground planes include Novatel's GNSS-750 hemispherical choke ring ground plane, new types of frequency selective cut-off choke ring ground planes, Electronic Band Gap (EBG) and Artificial Magnetic Conductor (AMC) Ground planes and resistivity tapered ground planes made by the Trimble Corp. The design goals of these approaches is to suppress edge diffraction effects from GPS antennas placed on top of planar metal ground planes. They are not flexible enough to be installed with GPS antennas on top of aircraft with curved, cylindrical shape fuselages. They tend to be large, heavy, expensive, inflexible and not suitable for use in compact, portable systems or on aircraft. Many such designs are also limited by bandwidth and cannot cover the entire GNSS band.

BRIEF SUMMARY

System and method embodiments are disclosed for suppressing back radiation caused by a GPS antenna placed on top of the fuselage of an aircraft. These embodiments consist of two constituent parts: a Reduced Surface Wave (RSW) antenna which is placed on top of an Electromagnetic Band Gap (EBG) ground plane that is conformal to the fuselage of the aircraft. Different embodiments of both the antenna and the EBG ground plane are made from a combination of non-conducting, conducting and resistive electro-textiles are used in combination as needed. The required combination of the various electro-textiles depends on the specific design needed to widen frequency response and to enhance the suppression needed to attenuate creeping waves from propagating on the surface of the aircraft fuselage.

The RSW antenna and EBG ground plane work in conjunction to suppress back radiation caused by curved surface diffraction. The RSW antenna and the EBG ground plane are designed to work primarily in the two principal frequency bands—either the $L_1$ and $L_2$ bands of the modernized GPS system or the $L_1$ and $L_5$ bands. The former two bands are used in GPS navigation systems used in military aircraft whereas the latter two bands are used for navigation in civilian aircraft. However, the design of both the RSW antenna and its underlying EBG ground plane can be modified to operate over all three frequency bands of the Modernized GPS system.

In one embodiment the RSW antenna consists of a dual band annular ring microstrip patch antenna that is circular in shape made from E-textiles. The RSW antenna consists of five distinct layers. The top layer consists of an annular ring shape patch antenna made from conducting textile. The inner and outer radii of this conducting patch are designed to resonate in the GPS L1 band. This is followed by several layers of a non-conducting textile which constitute the top dielectric substrate layer. The third layer is a second annular ring shape patch antenna having inner and outer radii tuned to the second GPS band—either the L2 or the L5 band. The fourth layer consists of more layers made from non-conducting textiles. The fifth layer is layer made from a conducting textile. The whole multi-layer assembly is stitched together to make a consolidated single entity which is then placed to be conformal to the surface of the aircraft fuselage. The entire inner circumferential surface is short-circuited or electrically connected the fuselage of the aircraft. An alternate method of constructing this electro-textile antenna is to use intervening electro-textiles as layers of a composite material more commonly used in construction of special aircraft. If the fuselage of the aircraft is shaped like a narrow cylinder the circular annular ring patch the shape of the annular ring antenna may need to be elliptical in shape to conform better to the shape of the aircraft.

The RSW antenna described above is placed on the top surface of an EBG (Electronic Band Gap) ground plane also made from electro-textiles to allow the EBG to be flexible and conformal to the surface of the aircraft fuselage. These EBG ground planes are again made from a combination of conducting, non-conducting and resistive textiles depending on the specific design that is used. The frequency bandwidth of both the RSW antenna and the EBG ground plane can be expanded to cover the L1, L2 and L5 bands by using a combination of resistive and conductive E-textiles.

In a further embodiment, a ground plane including flexible electro-textiles is disclosed. The ground plane includes a first two-dimensional layer having a periodic array of conducting patches made from conducting electro-textiles, a second layer comprising at least one layer of non-conducting textiles that act as a dielectric substrate, and a third highly-conducting layer made from conducting textiles. In this embodiment, the second layer is sandwiched between the first and third layers and each conducting patch further comprises a conducting "via" (e.g. a metal pin) connecting it to the highly conducting layer. This ground plane is configured to operate as a frequency selective surface with electronic band gap characteristics to suppress edge and curved surface diffraction effects.

In a further embodiment, an antenna system having reduced back radiation is disclosed. The antenna system includes an antenna and ground plane. The antenna includes electro-textiles and is configured to operate in at least the frequency range between 1.1-1.6 GHz. The ground plane includes electro-textiles and is configured to operate as a frequency selective surface with electronic band gap characteristics to suppress edge and curved surface diffraction effects. In this system, the antenna and ground plane are configured to be located on a curved surface and to radiate with a directional radiation pattern having attenuated back lobes.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

FIGS. 3A-3D schematically illustrate various radiation paths of an antenna placed on an aircraft according to embodiments of the invention.

Figure 4:
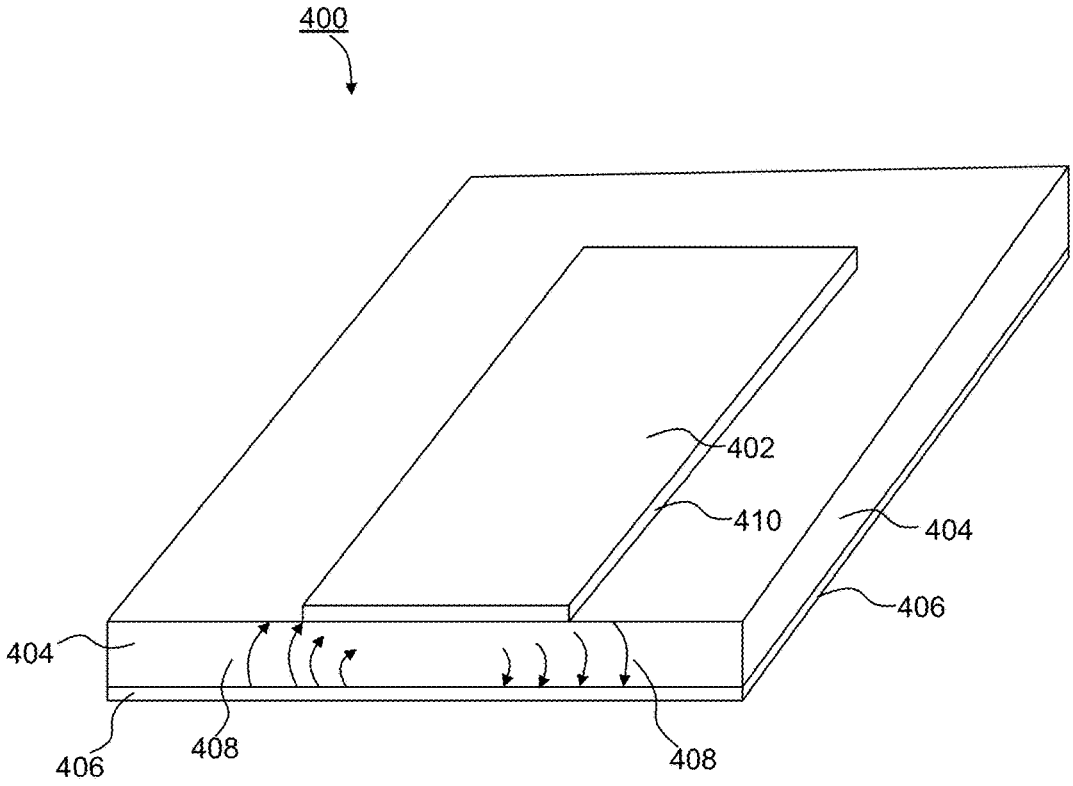

FIG. 4 schematically illustrates a simplified rectangular patch antenna according to an embodiment of the invention.

Figure 5:
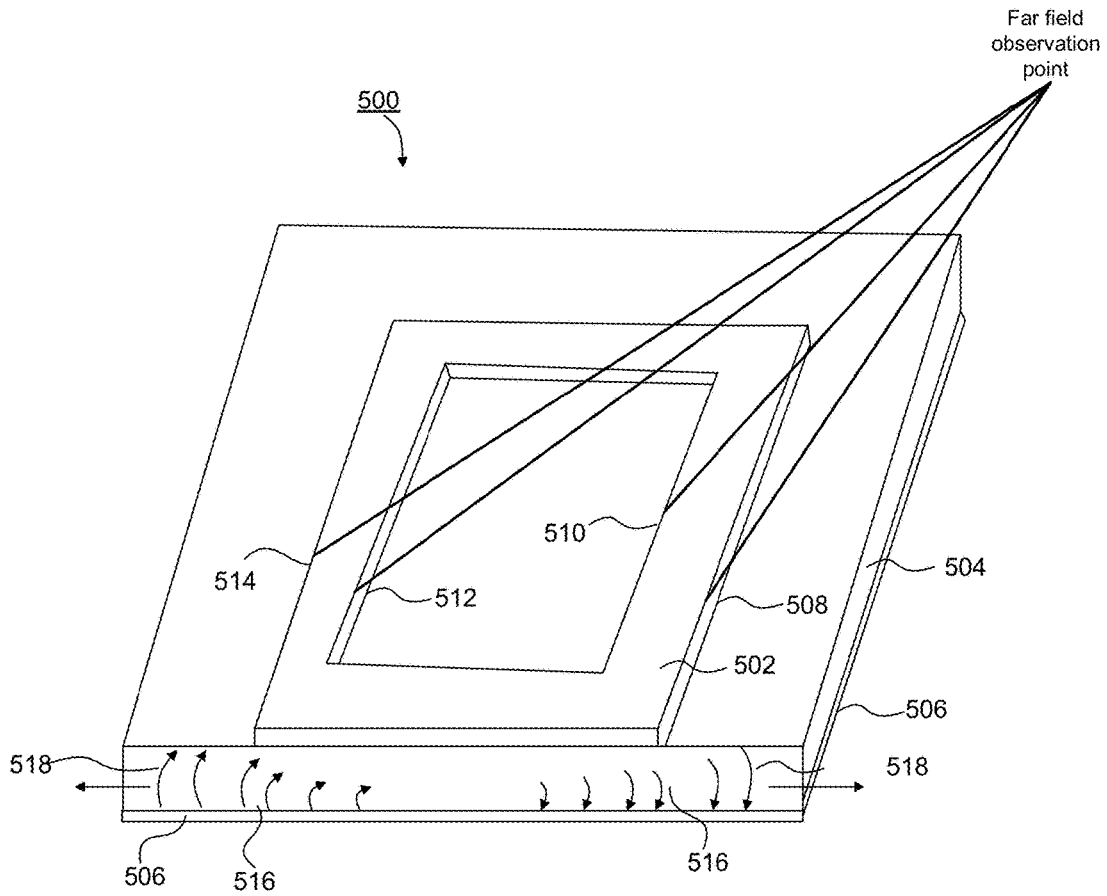

FIG. 5 schematically illustrates a rectangular loop patch antenna according to an embodiment of the invention.

Figure 6:
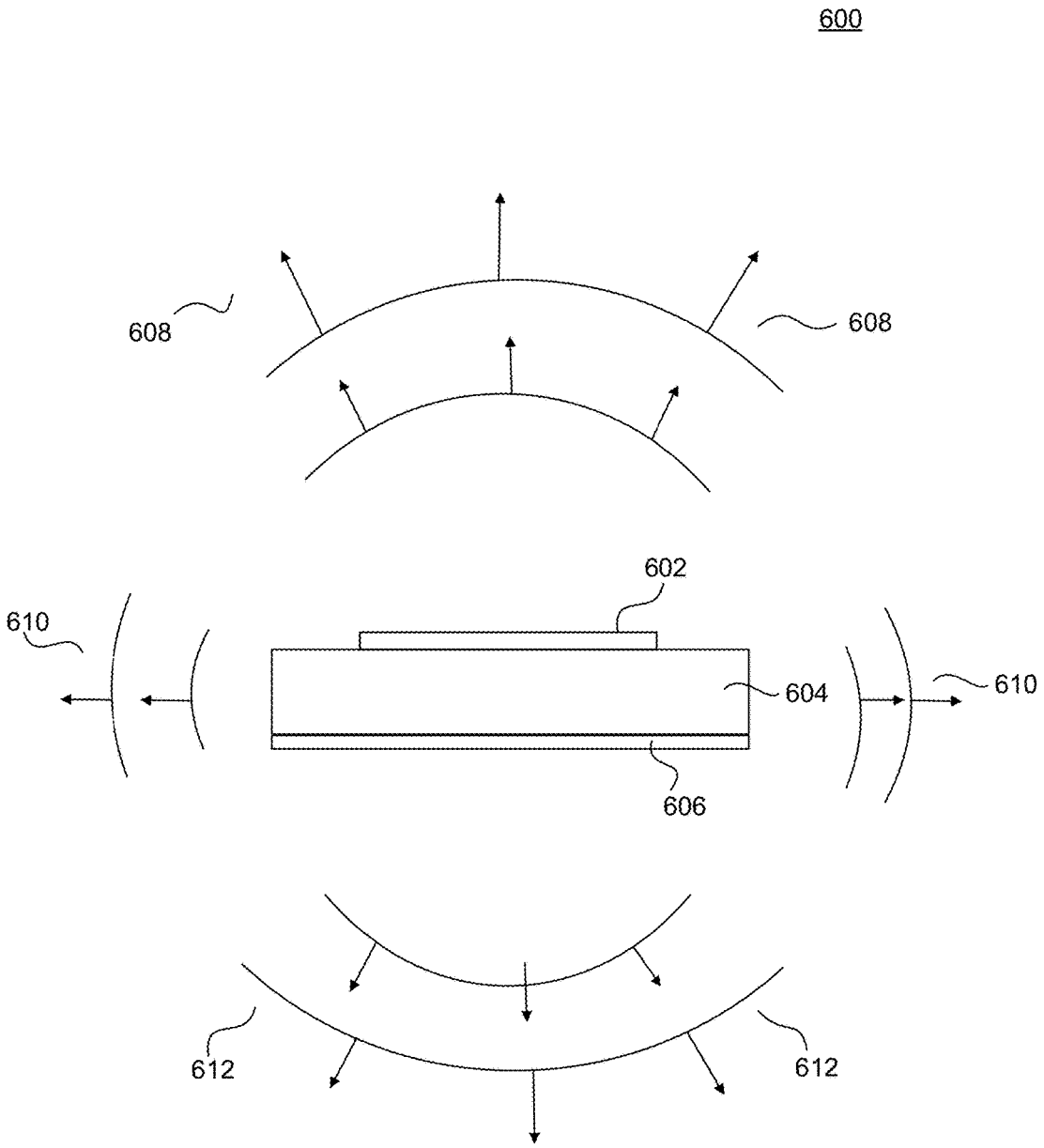

FIG. 6 schematically illustrates radiation emitted from a patch antenna viewed edge-on according to an embodiment of the invention.

Figure 7:
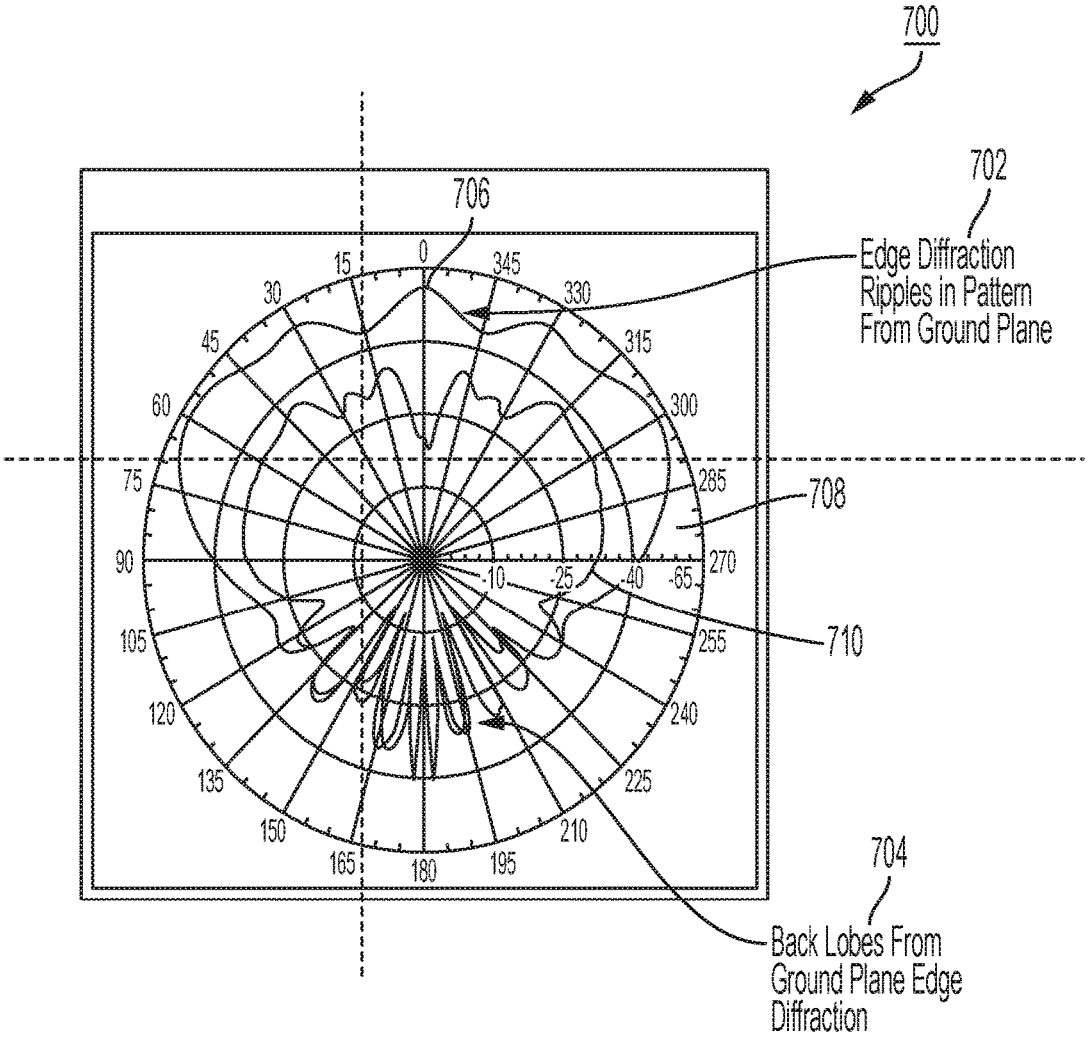

FIG. 7 illustrates the measured radiation pattern of a patch antenna using the same geometric construction as presented in FIG. 6 according to an embodiment of the invention.

Figure 8:
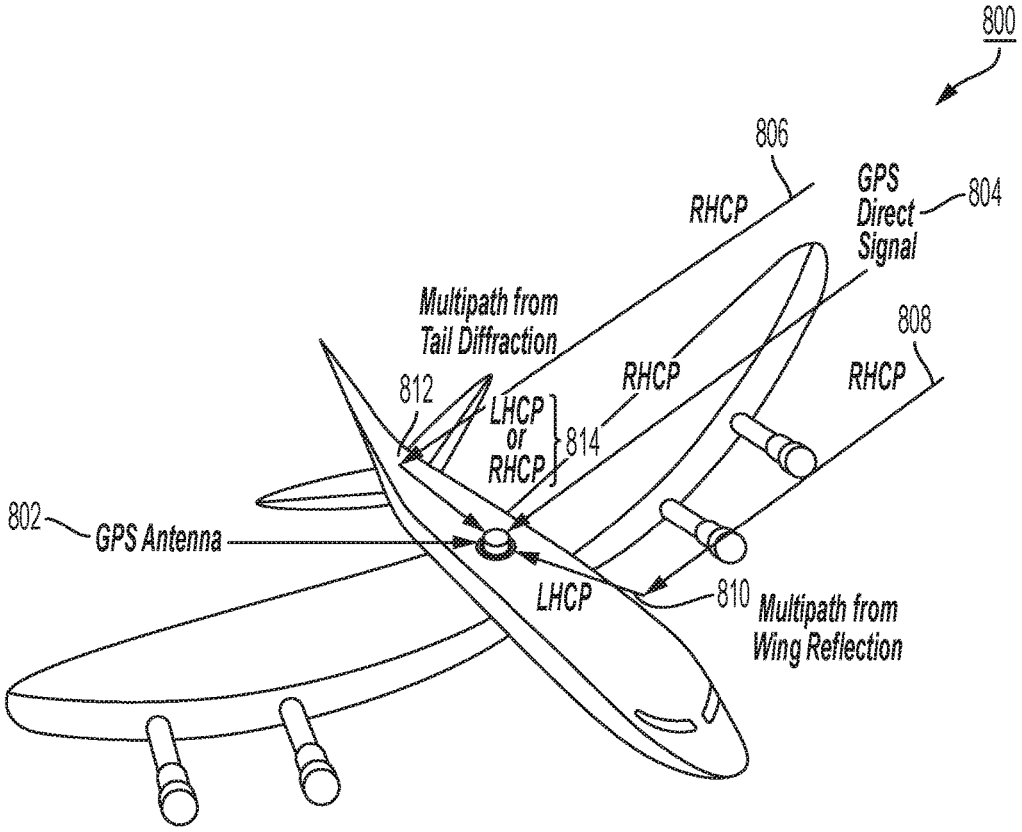

FIG. 8 schematically illustrates the concept of multi-path interference of a signal received by an antenna on an aircraft from a GPS satellite according to an embodiment.

Figure 9A:
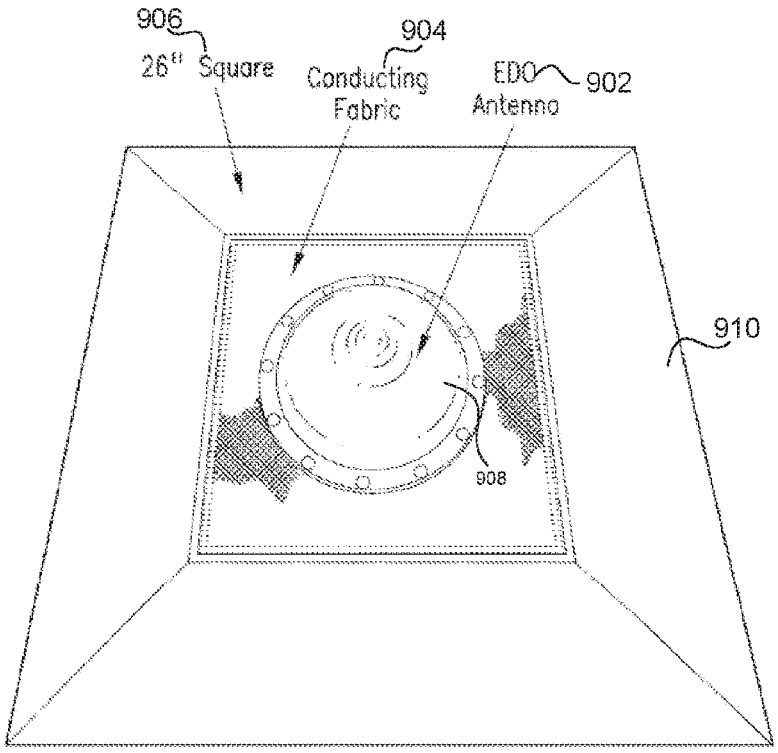

FIG. 9A illustrates a GPS antenna on a ground plane constructed from electro-textiles having a spatially dependent resistivity according to an embodiment of the invention.

Figure 9B:
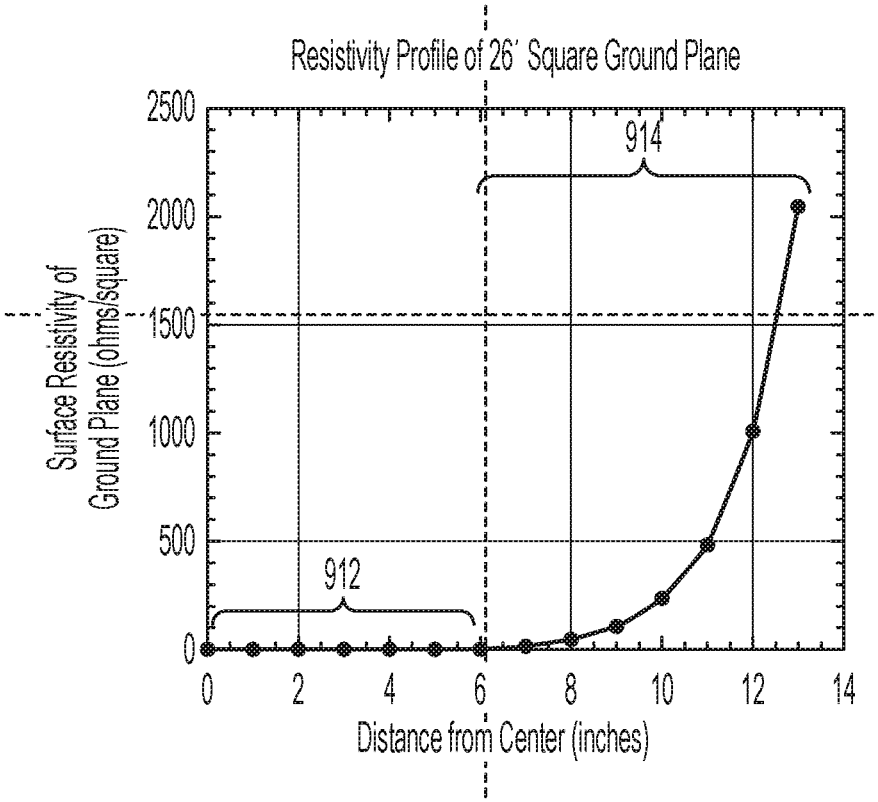

FIG. 9B illustrates the exponentially increasing resistivity of the ground plane of FIG. 9A according to an embodiment.

Figures 10A, 10B:
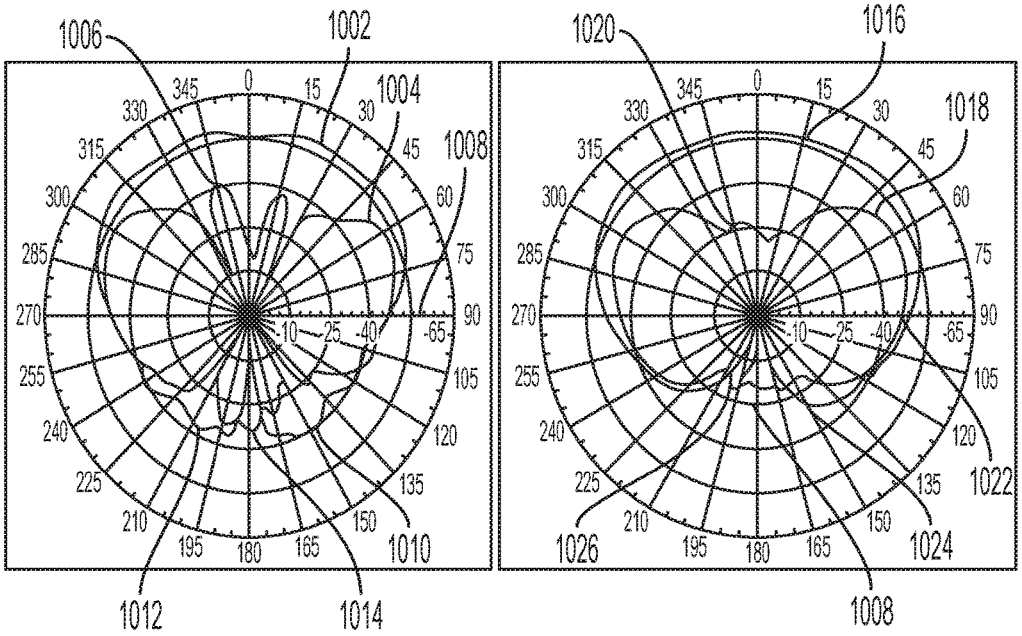

FIG. 10A presents the measured radiation pattern of a GPS antenna on a 26" metal ground plane radiating at 1.5754 GHz (L1) according to an embodiment of the invention.

FIG. 10B presents the measured radiation pattern of a GPS antenna on the 26" square resistive textile ground plane of FIG. 9A radiating at 1.5754 GHz (L1) according to an embodiment of the invention.

Figure 11A:
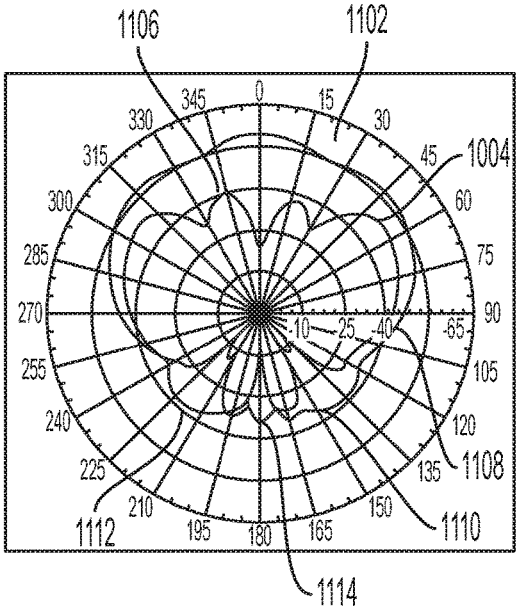

FIG. 11A presents the measured radiation pattern of a GPS antenna on a 26" metal ground plane radiating at 1.227 GHz (L2) according to an embodiment of the invention.

Figure 11B:
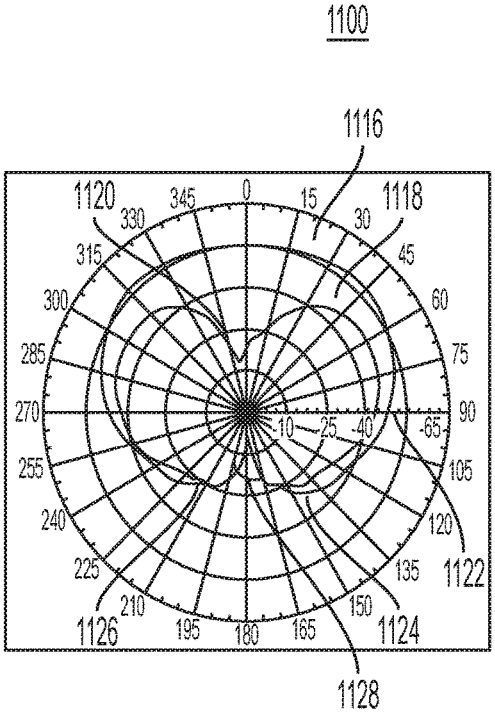

FIG. 11B presents the measured radiation pattern of a GPS antenna on the 26" square resistive textile ground plane of FIG. 9A radiating at 1.227 GHz (L2) according to an embodiment of the invention.

Figure 12:
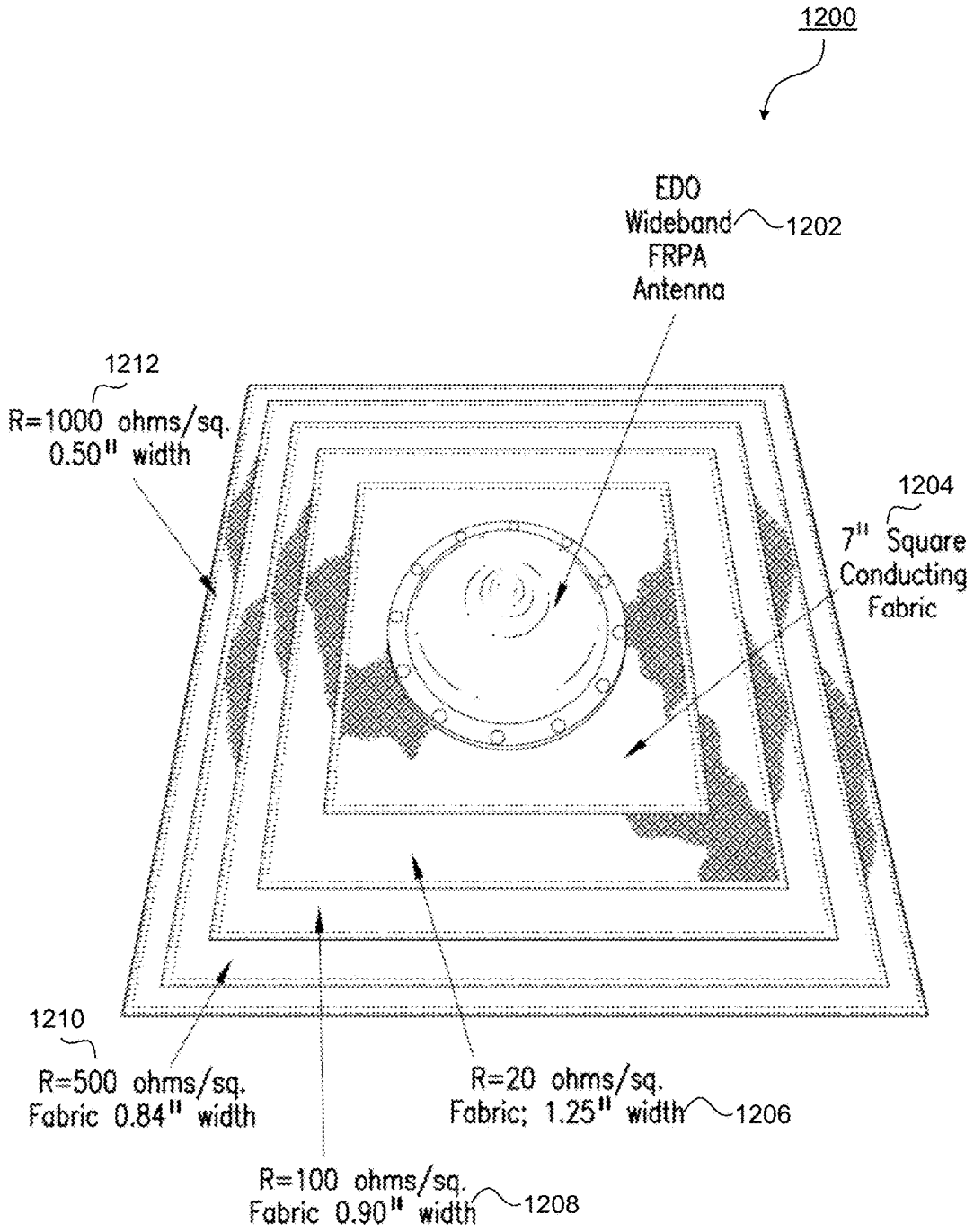

FIG. 12 illustrates a GPS antenna on a ground plane constructed from electro-textiles having a stepped spatially dependent resistivity according to an embodiment of the invention.

Figures 13A, 13B:
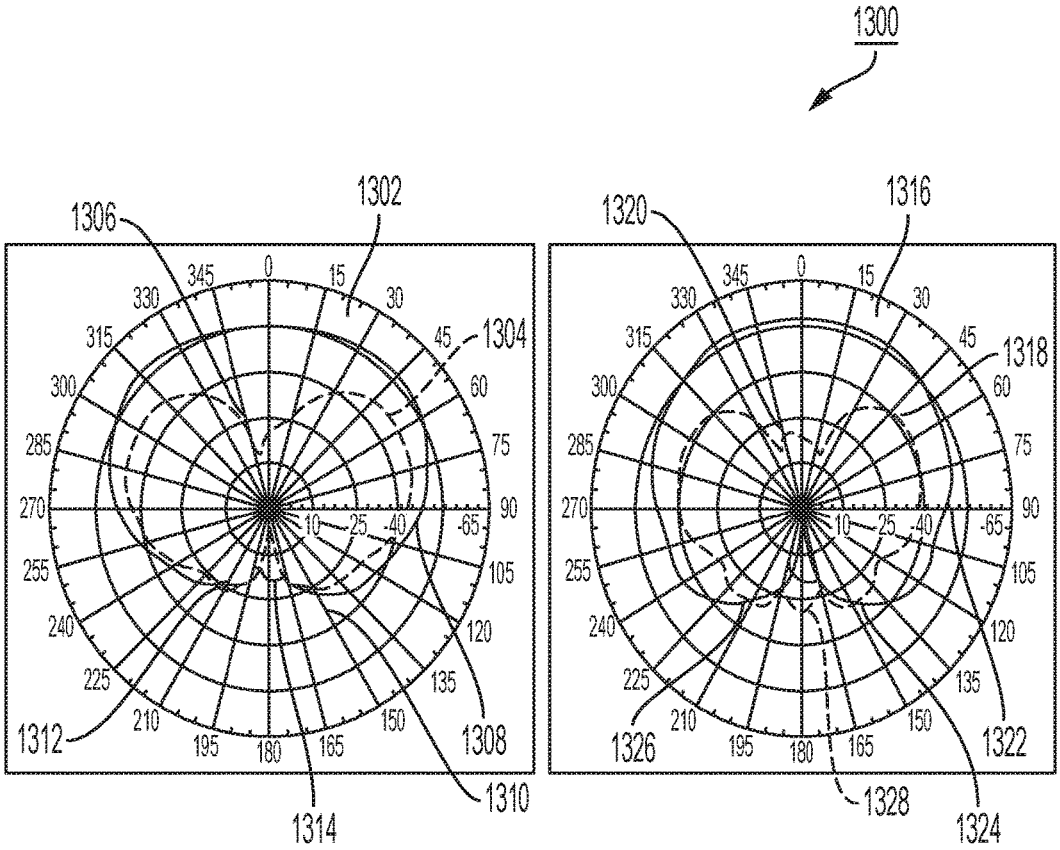

FIG. 13A presents the measured radiation pattern of a GPS antenna on the 26" square resistive textile ground plane of FIG. 9A radiating at 1.227 GHz (L2) according to an embodiment of the invention.

FIG. 13B presents the measured radiation pattern of a GPS antenna on the 14" step tapered resistive textile ground plane radiating at 1.227 GHz (L2) according to an embodiment of the invention.

Figure 14:
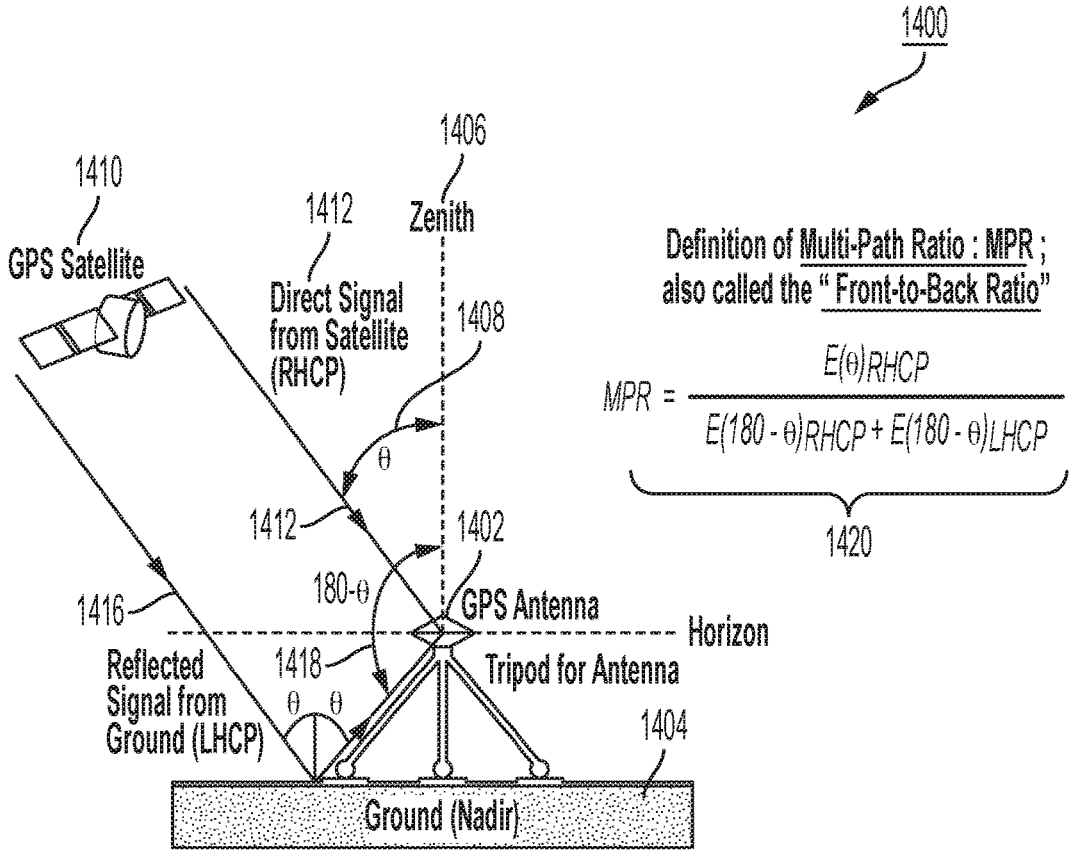

FIG. 14 schematically illustrates the concept of multi-path interference and provides a definition of the "multi-path ratio" according to an embodiment.

Figure 15:
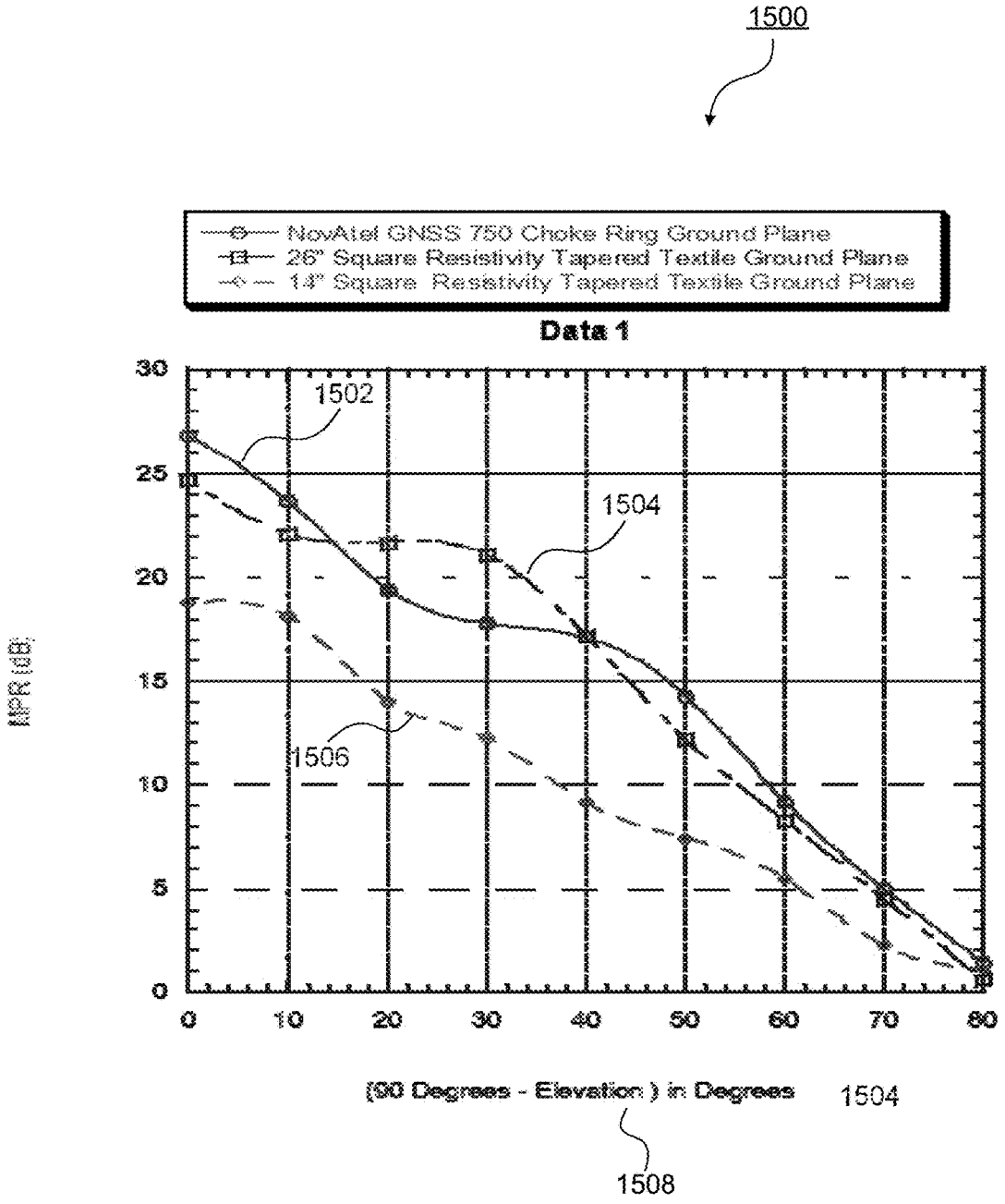

FIG. 15 presents the measured angle-dependent multipath ratio for the systems of FIG. 9A and FIG. 12 in comparison with a conventional device according to an embodiment.

Figure 16:
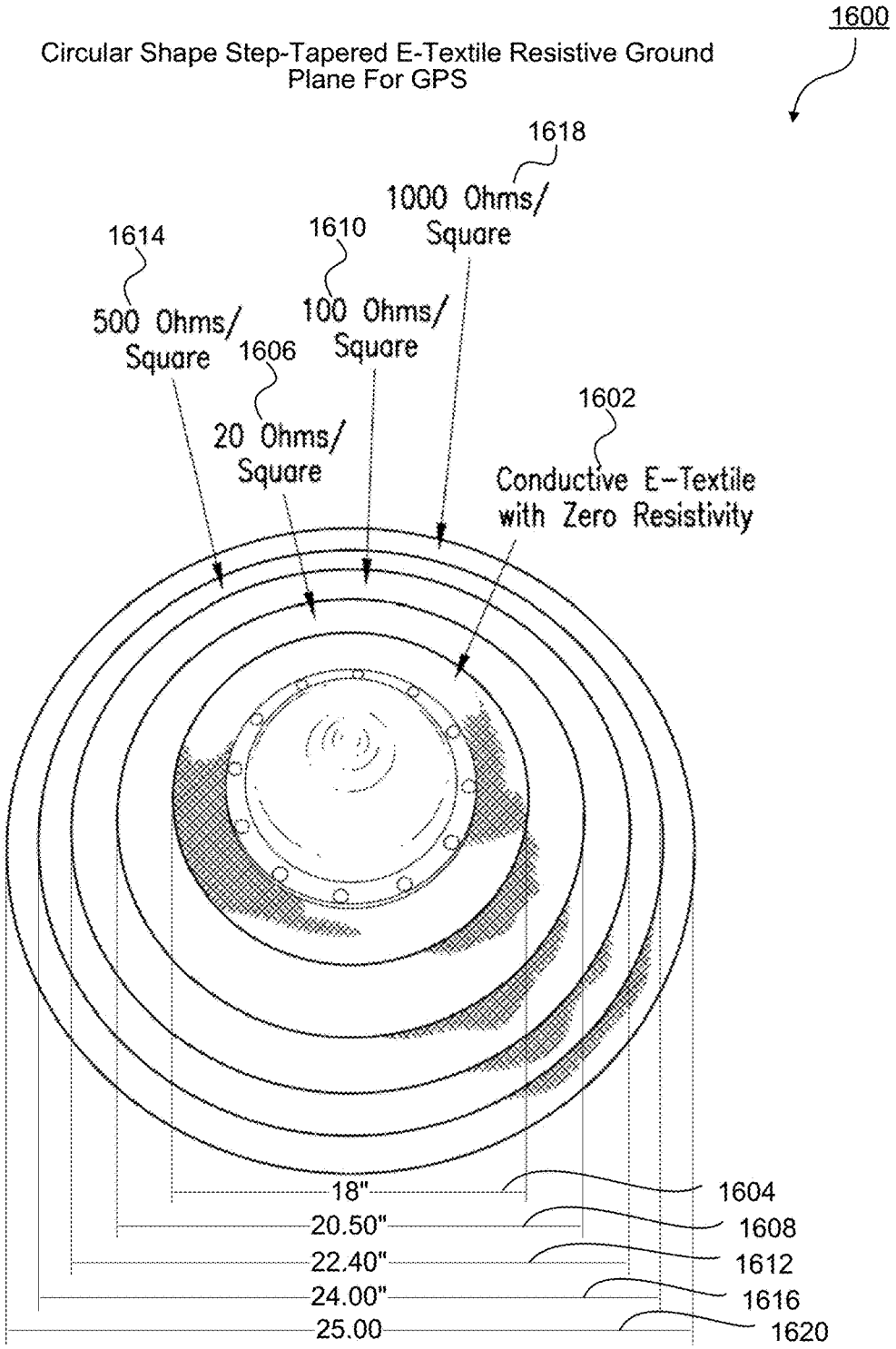

FIG. 16 presents a design of a ground plane having a stepped spatially dependent resistivity with a circular geometry according to an embodiment of the invention.

FIGS. 17A-17D present the designs of various electronic band gap ground planes constructed from electro-textiles according to embodiments of the invention.

Figure 17A:
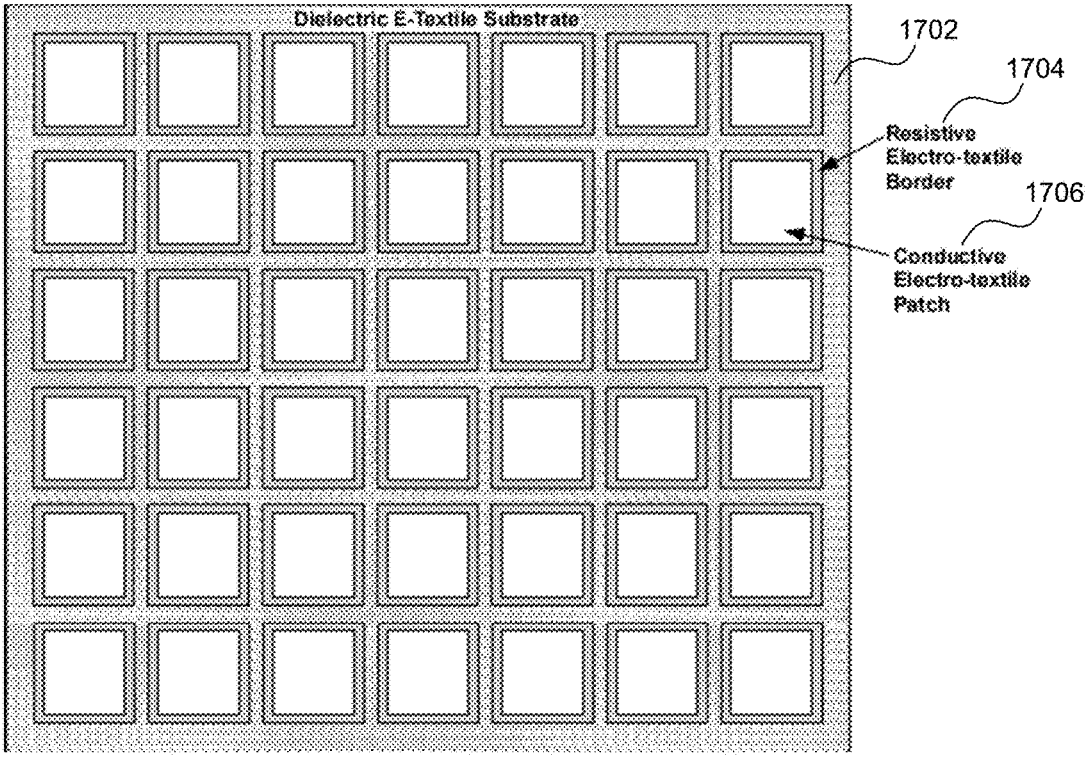
Figure 17B:
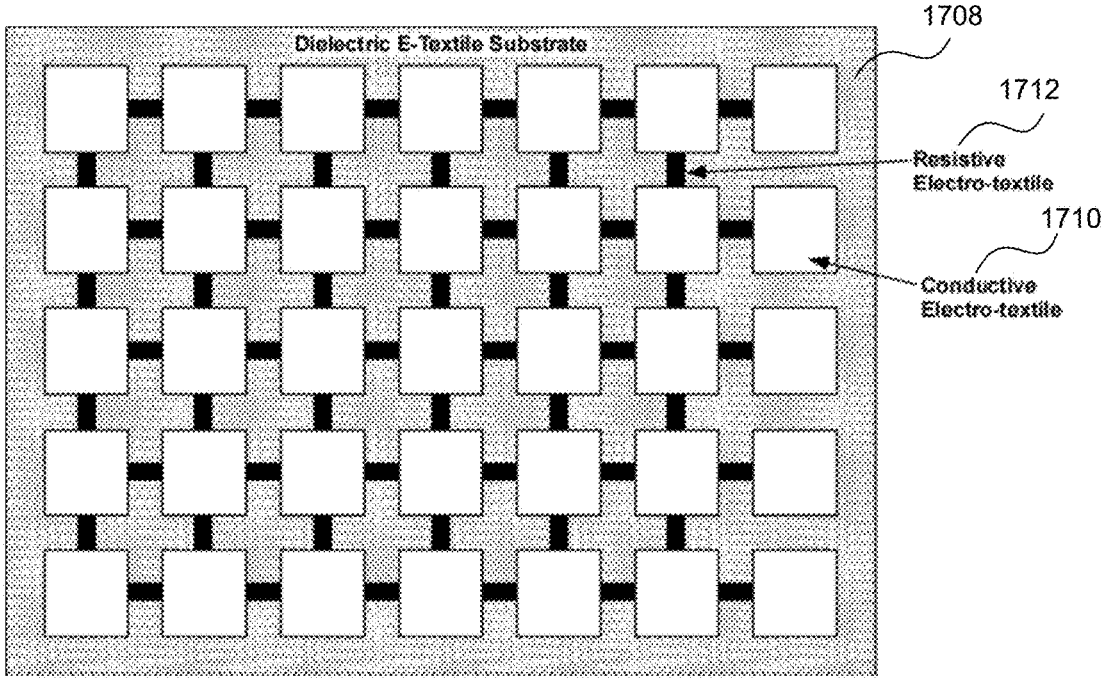
Figure 17C:
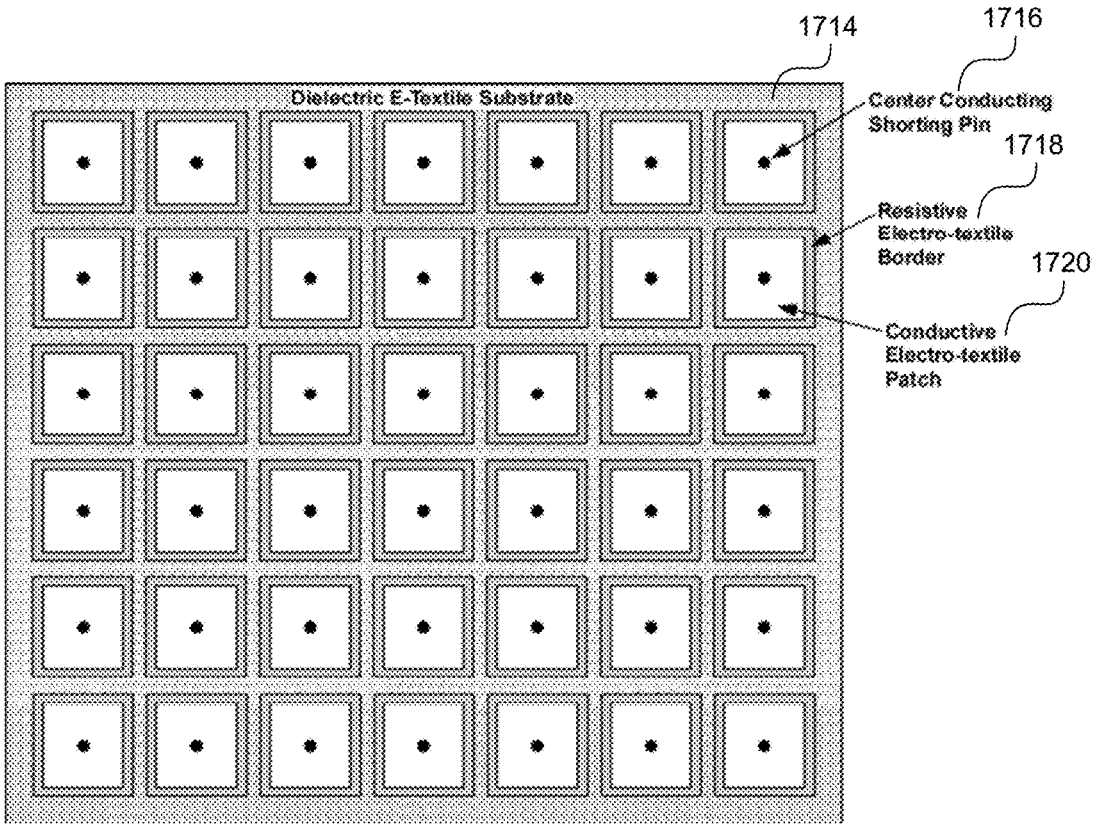
Figure 18:
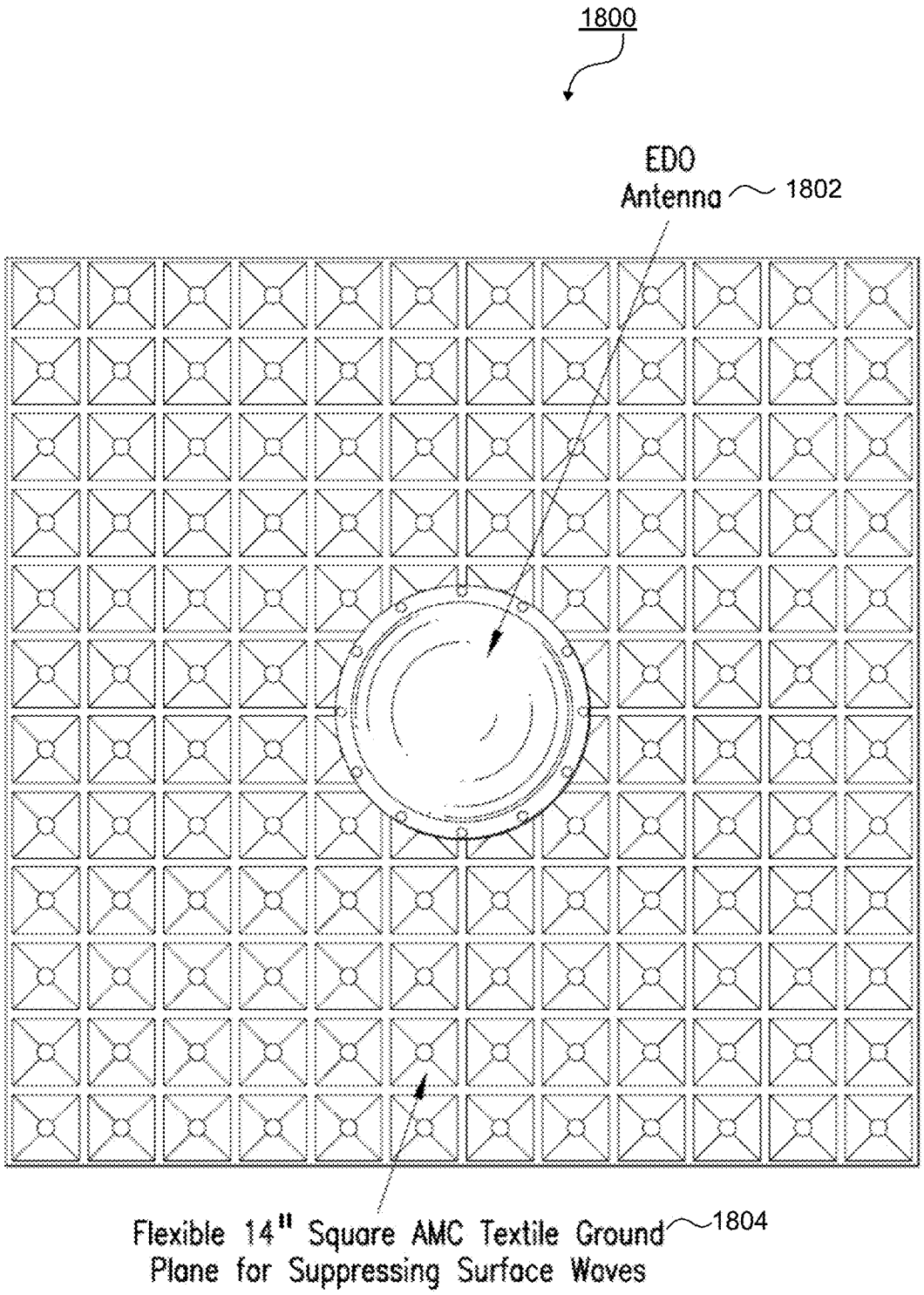

FIG. 18 is a picture of system including a GPS antenna residing on an electronic band gap ground plane having the design of FIG. 17C according to an embodiment of the invention.

Figure 19:
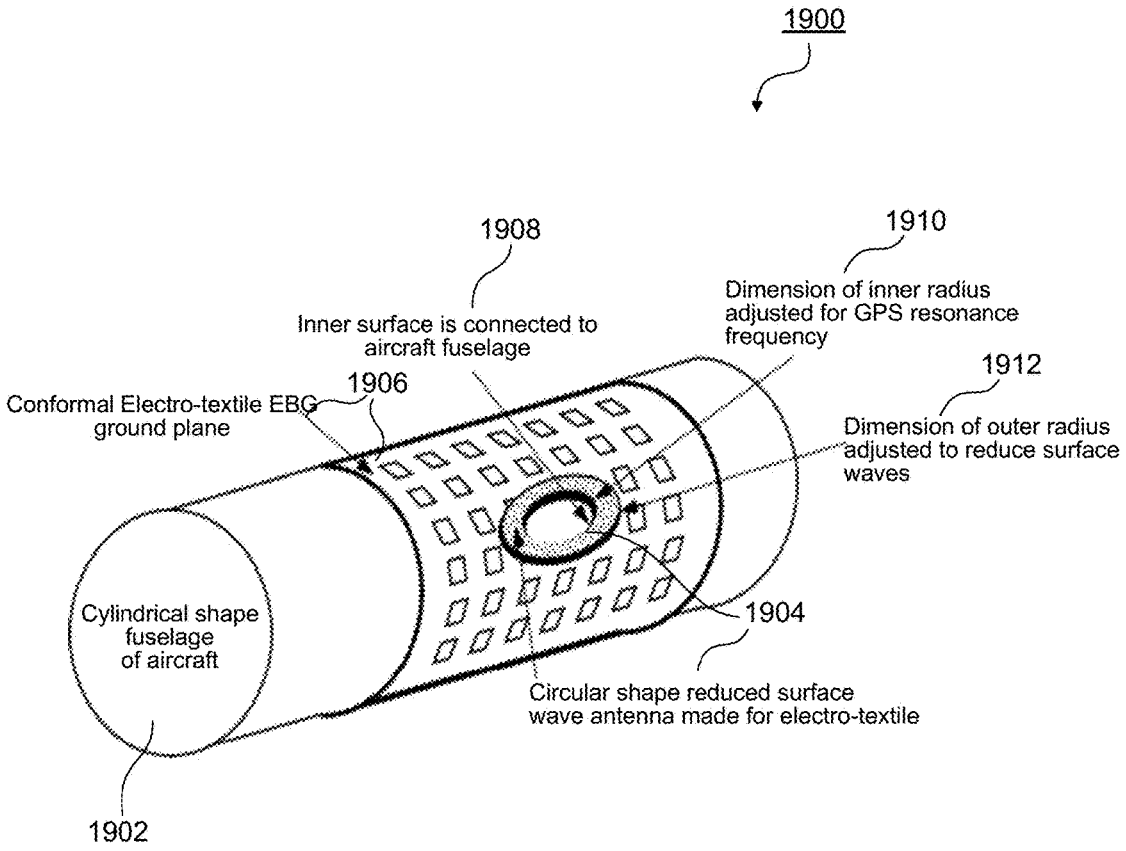

FIG. 19 illustrates the placement of a system including a reduced surface wave antenna and an electronic band gap ground plane on a cylindrical surface according to an embodiment of the invention.

Figures 20A, 20B:
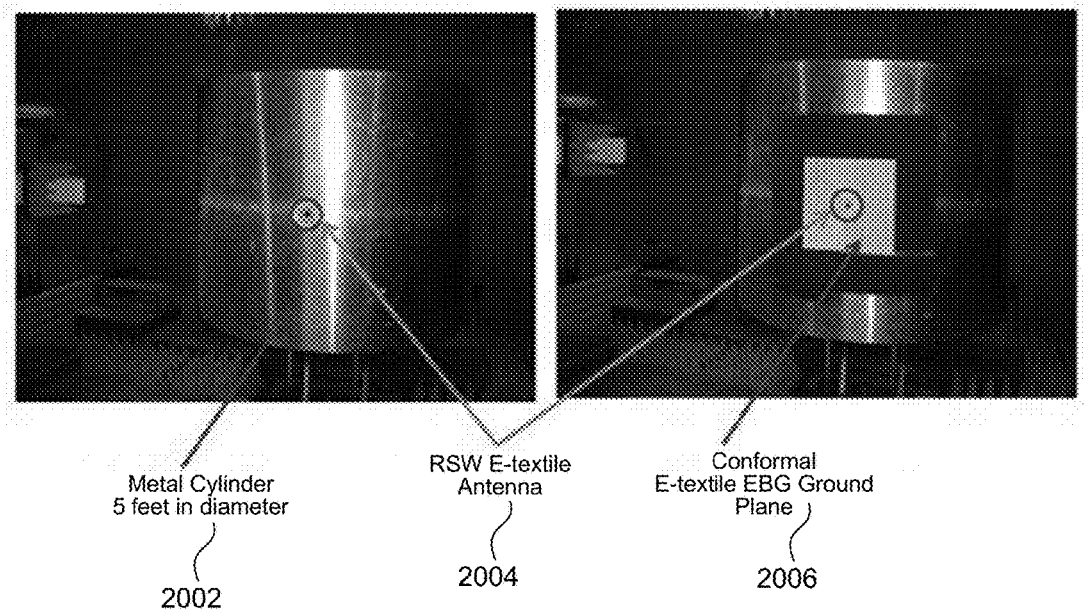
Figure 20C:
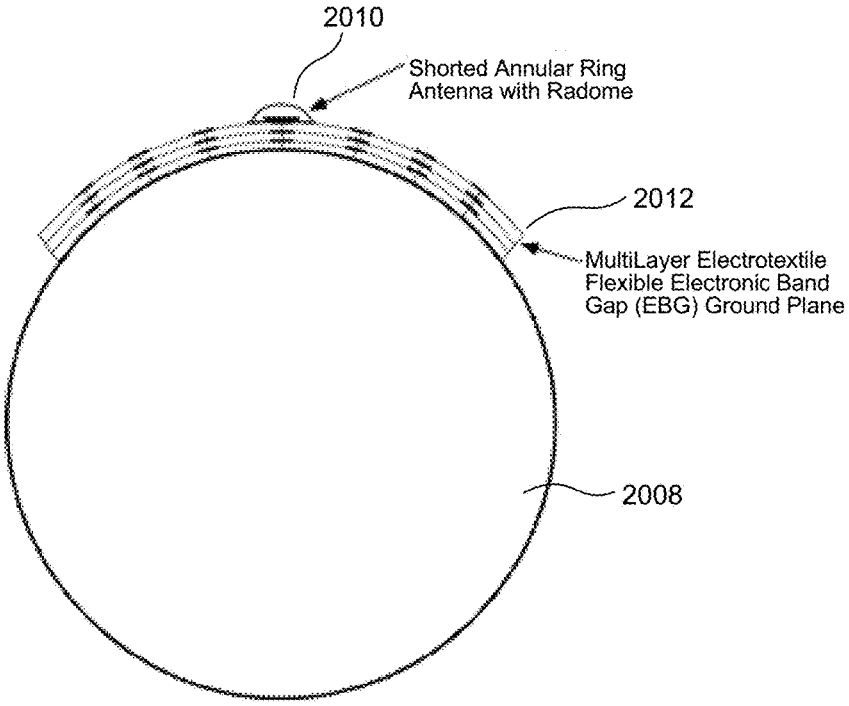

FIGS. 20A-20C schematically illustrate various example configurations in which embodiment systems were tested on cylindrical surfaces.

Figure 21A:
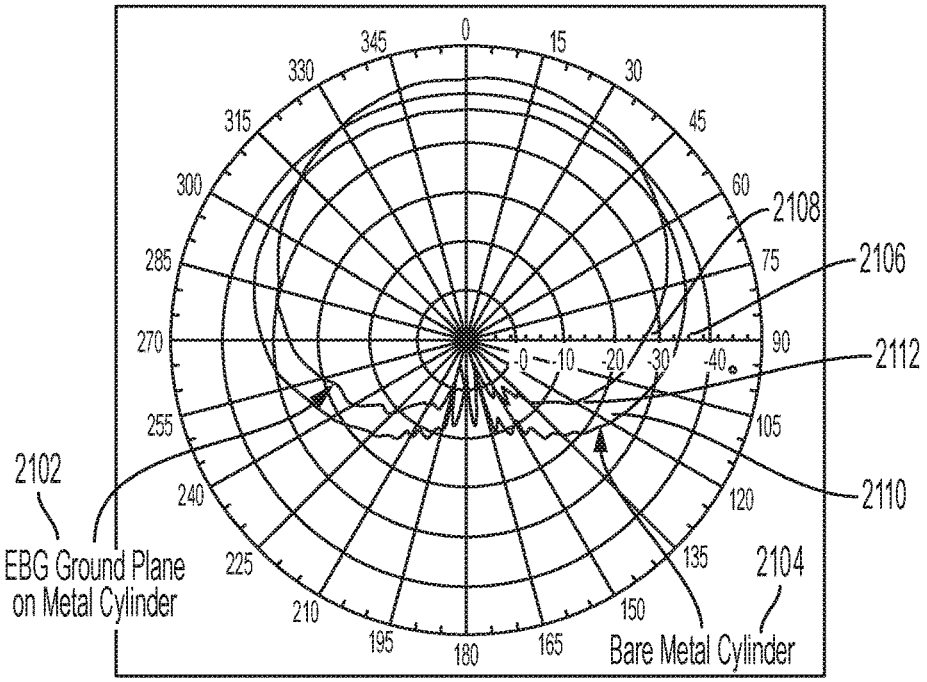

FIG. 21A presents the measured radiation pattern of a GPS antenna on a bare metal cylinder in comparison with that of the same antenna on an electronic band gap ground plane according to an embodiment.

Figure 21B:
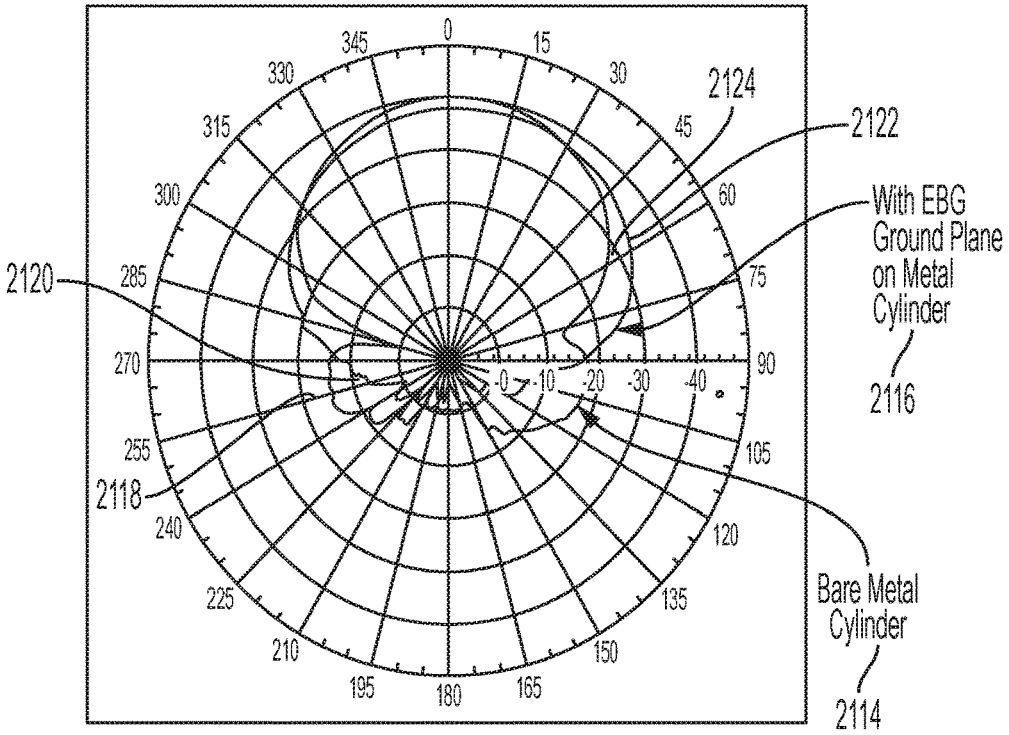

FIG. 21B presents the measured radiation pattern of a RWS antenna on a bare metal cylinder in comparison with that of the same antenna on an electronic band gap ground plane according to an embodiment.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

It is to be appreciated that any additional disclosure found in the Figures is meant to be exemplary and not limiting to any of the features shown in the Figures and described in the specification below.

DETAILED DESCRIPTION OF THE INVENTION

This specification discloses one or more embodiments that incorporate the features of this invention. The disclosed embodiment(s) merely exemplify the invention. The scope of the invention is not limited to the disclosed embodiment(s). The invention is defined by the claims appended hereto.

The embodiment(s) described, and references in the specification to "one embodiment," "an embodiment," "an example embodiment," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is understood that it is within the knowledge of one skilled in the art to effect such feature, structure, or characteristic in connection with other embodiments whether or not explicitly described.

Figure 1A:
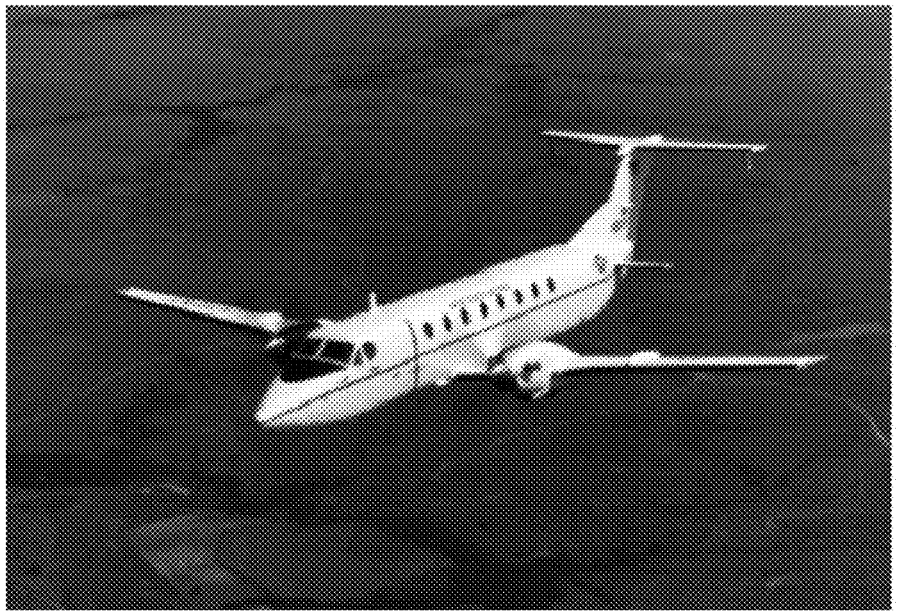
FIG. 1A is a picture of a representative commercial aircraft on which embodiments of the invention can reside.
Figure 1B:
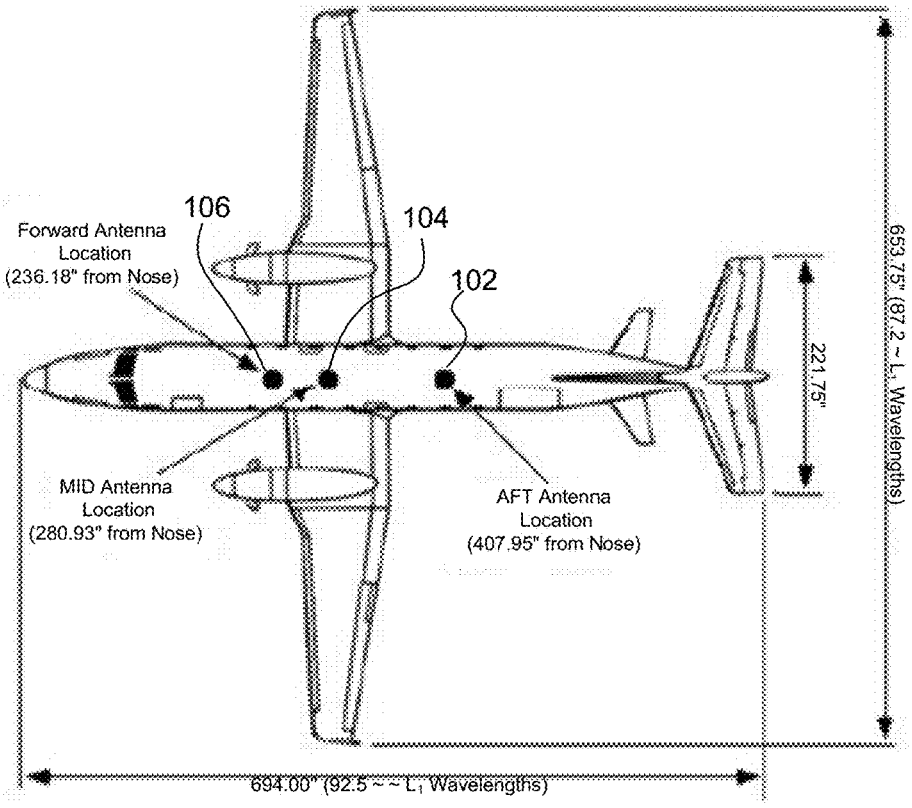
FIG. 1B illustrates the placement of embodiment systems on the aircraft of FIG. 1A according to an embodiment.

Embodiments have been developed and tested using computer simulations combined with scale model testing on representative aircraft. FIG. 1A is a picture of a representative commercial aircraft (i.e., Beechcraft 1900C) on which GPS antennas may be located according to embodiments of the invention, although the invention is applicable to any aircraft or other movable object. FIG. 1B is a top-down illustration of the aircraft pictured in FIG. 1A. FIG. 1B illustrates example locations of GPS antennas. In this illustration there are three locations 102, 104 and 106, representing the aft, mid, and forward antenna locations respectively.

Figure 2A:
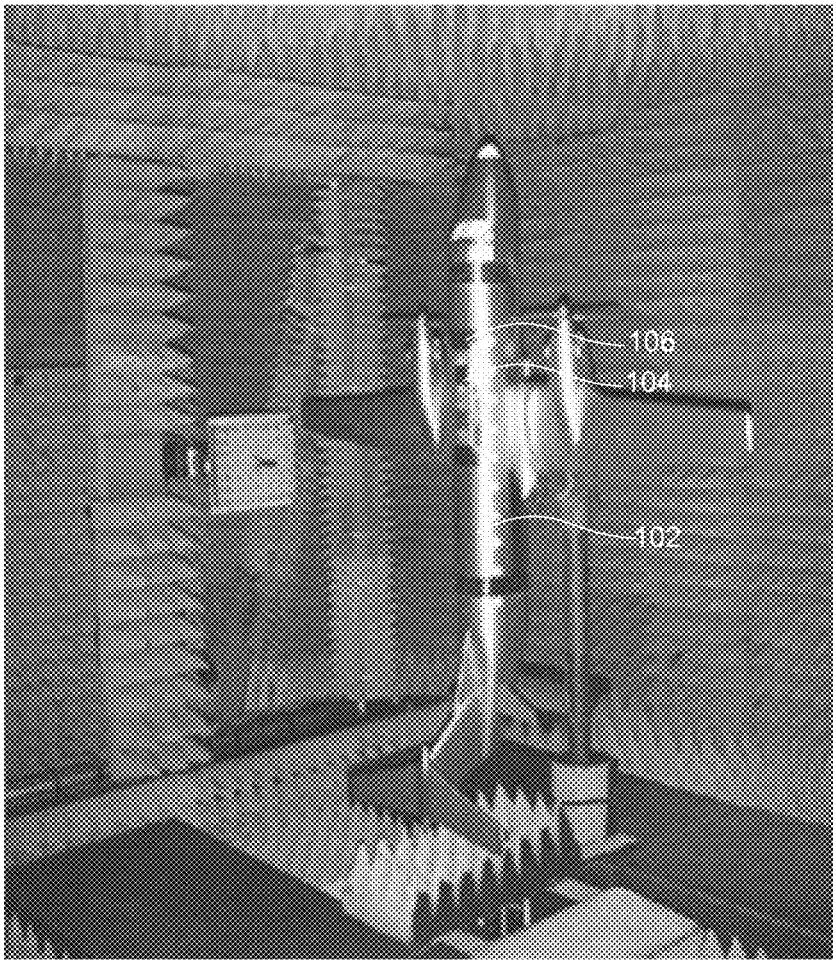
FIG. 2A illustrates a scale model of the aircraft of FIG. 1A used for testing of various embodiments according to an embodiment.

FIG. 2A illustrates a scale model of the aircraft pictured in FIG. 1A. This scale model was used to carry out detailed measurements of antenna performance. The three antenna locations described with respect to FIG. 1B are also shown in FIG. 2A. The three positions are indicated as 102, 104 and 106 and correspond to the aft, mid, and forward antenna locations, respectively.

Figure 2B:
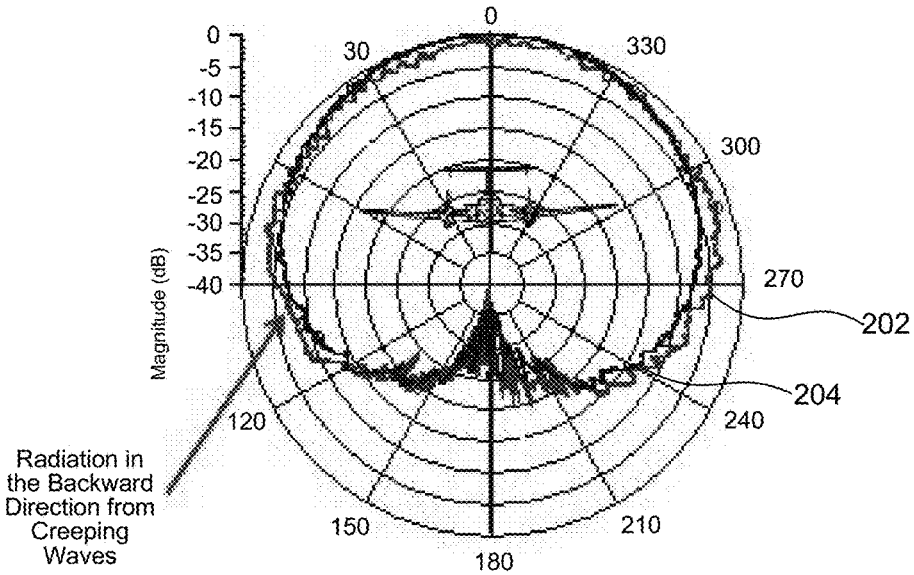
FIG. 2B illustrates the measured and calculated roll-plane radiation pattern of an antenna on the scale model aircraft of FIG. 2A according to an embodiment of the invention.

FIG. 2B illustrates a radiation pattern of an antenna on the scale model aircraft shown in FIG. 2A. There are two curves shown in FIG. 2B. One of the curves is a computer simulated radiation pattern and the other is a measured radiation pattern. The two curves are in close agreement indicating the reliability of the results. FIG. 2B illustrates the roll-plane radiation pattern. The geometry of the roll-plane is indicated by the presence of the sketch of the aircraft in FIG. 2B. The "roll-plane" is a plane perpendicular to the cylindrical axis of the aircraft as indicated in the figure. The geometric construction of the roll-plane is well known to those skilled in the art and thus need not be discussed further.

The direction measured upward in FIG. 2B is indicated by 0° and represents the radiation propagating in a direction directly above the aircraft. Likewise, the direction 180° in FIG. 2B points downward and corresponds to the radiation propagated in a direction directly below from the aircraft. The results of FIG. 2B show that an antenna placed directly on an aircraft radiates upward as well as downward.

For GPS antenna applications, any downward propagating radiation (i.e., for directions below the horizon) is unwanted radiation. Due to the reciprocity theorem, an antenna that can radiate downward can also receive radiation coming upward from the downward direction. Thus, this type of antenna is susceptible to interference from ground based sources. Feature 202 in this figure illustrates that there is a significant amount of radiation propagating horizontally. Feature 204 indicates a typical downward direction of unwanted radiation.

Figure 3A:
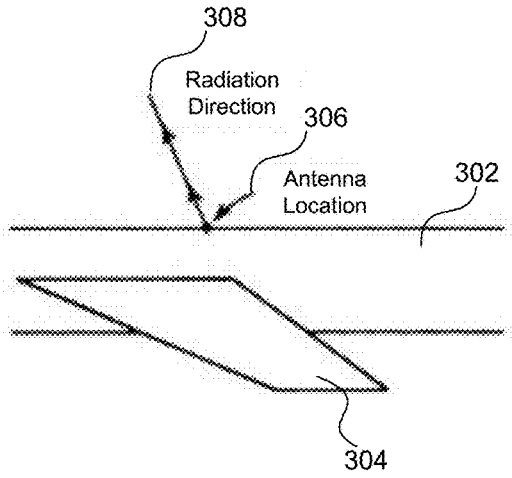
Figure 3B:
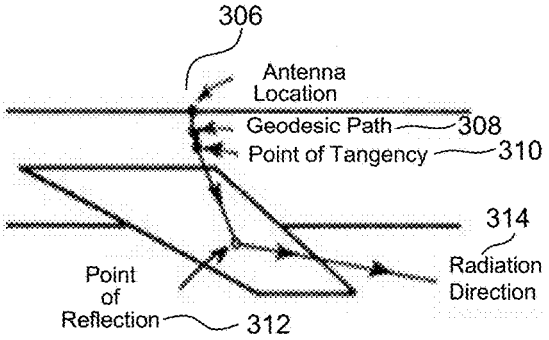

FIGS. 3A-3D illustrate various sources of reflected radiation. These figures illustrate a typical configuration of an antenna 306 mounted on the top of an aircraft fuselage 302. A wing 304 is also illustrated. In GPS applications, the antenna 306 is configured to communicate with a satellite in an upward direction 308. FIG. 3A illustrates that an antenna 306 located on top of an aircraft has a component of radiation that's radiated directly toward a satellite 308. In addition to the direct radiation 308, an alternative radiation path is indicated in FIG. 3B.

FIG. 3B illustrates the situation in which electromagnetic energy propagates along the side of the aircraft along a geodesic path 308. Some of this propagating energy is radiated at points of tangency 310. Some of this radiated energy can, in turn, be reflected at various reflection points 312. In this example, radiation reflects from points on the wing 312 and gives rise to reflected radiation 314. FIG. 3B illustrates just one of many directions 314 into which radiation from the antenna 306 can propagate.

Figure 3C:
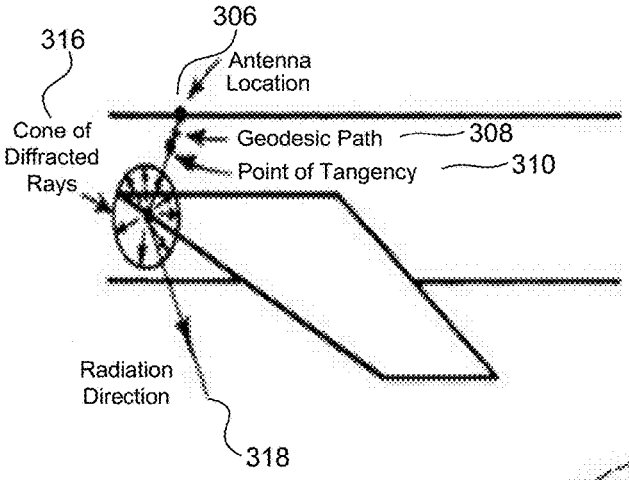

FIG. 3C shows another possibility for reflected radiation. Radiation can be emitted from the antenna 306, can propagate along the geodesic path 308 and when it encounters an edge surface of the aircraft such as a wing surface, it can give rise to a cone of diffracted rays 316. This shows that radiation is diffracted in many directions as indicated by 316. One of the many directions is also illustrated as 318.

Figure 3D:
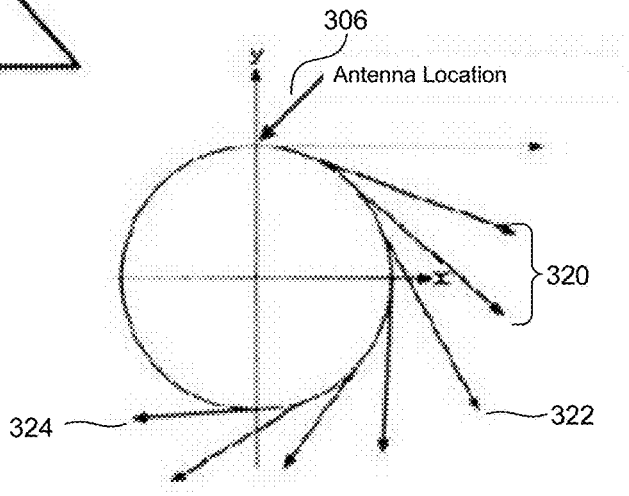

FIG. 3D illustrates the notion of creeping waves. An antenna 306 located on the top of a cylinder gives rise to waves that propagate around the side of the cylinder called creeping waves. As the creeping waves propagate they give rise to radiation in various directions 320. The circular shape in FIG. 3D corresponds to a cylindrical conductor such as an aircraft fuselage viewed along the symmetry axis of the cylinder. This is the same orientation as that was assumed for the computed and measured radiation shown in FIG. 2B.

FIG. 3D illustrates a number of directions for radiation originating from creeping waves that diffract around the cylinder. For example, feature 322 illustrates a downward propagating radiation beam and feature 324 illustrates radiation propagating to the left that has originated from creeping waves that propagate around the cylinder.

FIG. 4 is a schematic illustration of a microstrip patch antenna 400. Microstrip patch antennas are commonly used as GPS antennas mounted on aircraft. Such antennas are chosen due to their low profile for reducing aerodynamic drag and their low cost and ease of manufacture. One drawback of a patch antenna, however, is the fact that such antennas are particularly prone to creating the creeping wave diffraction discussed in the previous figures. Creeping waves are generated by patch antennas due to the use high dielectric constant substrates as discussed below.

FIG. 4 shows a simplified illustration of a rectangular patch antenna. This antenna includes a microstrip patch 402 which is typically made of metal or other good conductor. The microstrip patch 402 resides on a dielectric substrate 404 which is illustrated as a rectangular slab of dielectric material. This slab of dielectric material 404 is placed on a ground plane 406. Typically the ground plane is metal or other type of good conductor. The ground plane 406 and the microstrip patch 402 represent two terminals of an antenna.

Electromagnetic waves are created when an oscillating (AC) voltage difference is applied between the microstrip 402 and the ground plane 406. The electromagnetic waves give rise to radiation that is used for communication purposes. The oscillating voltage difference between the microstrip 402 and the ground plane 402 also generates electromagnetic fields in the dielectric as illustrated by feature 408 showing a typical pattern of electromagnetic fields in the dielectric. These fringing fields 408 give rise to waves that propagate in the plane of the dielectric. These waves propagating in the plane of the dielectric generate surface waves when mounted on an aircraft. It is these surface waves that gives rise to the creeping waves that propagate around the cylinder of the aircraft fuselage as discussed above.

FIG. 5 illustrates a patch antenna that may be used for GPS communications. This patch antenna includes a rectangular metal patch 502 on top of a dielectric substrate 504. The dielectric substrate is a rectangular slab of material that resides on ground plane 506. The ground plane is typically made of metal or other good conductor. Each edge of the microstrip patch such as 508, 510, 512 and 514 gives rise to radiation. These combine to give the radiation field at a typical far field observation point as indicated. The various radiation sources interfere constructively and destructively and will rise to ripples in the radiation pattern as discussed below.

FIG. 5 also illustrates fringing fields 516 in the dielectric layer. These fringing fields are oscillating electromagnetic fields that give rise to propagating waves 518 in the plane of the antenna. It is these propagating waves that generate surface waves when this antenna is mounted on an aircraft. These surface waves generate creeping waves that propagate around the cylinder representing the aircraft fuselage. The antenna illustrated schematically in FIG. 5 gives rise to radiation in all directions but in differing magnitudes.

FIG. 6 illustrates a schematic radiation pattern of the microstrip patch antenna illustrated in FIG. 5. This figure illustrates the microstrip antenna viewed "edge-on." In this situation, the square loop patch antenna 502 illustrated in FIG. 5 is now seen edge-on as feature 602 in FIG. 6. The dielectric slab 504 of FIG. 5 is now seen edge-on as feature 604 in FIG. 6. Similarly the ground plane 506 illustrated in FIG. 5 is now seen as feature 606 viewed edge on in FIG. 6.

This antenna radiates upwardly as illustrated by upwardly propagating waves 608 in FIG. 6. This is the radiation that can interact with a satellite and can be used for GPS communications. In addition to the radiation that is radiated upwardly 608, there is also radiation 612 that propagates downward. This is the unwanted radiation that can interact with sources on the ground. Due to the reciprocity theorem, because the antenna is able to radiate in a downward direction 612, it is implied that the antenna can also receive radiation coming upward from the downward directions. This is a drawback because such reception from downward sources leaves this antenna susceptible to interference from ground based sources.

In addition to the upwardly propagating radiation 608 and the downward propagating radiation 612, this antenna also exhibits surface waves as indicated by waves 610 in FIG. 6. The surface waves 610 illustrated in FIG. 6 are generated by the fringing fields illustrated in FIGS. 4 and 5 as features 408 and 516 respectively. When a surface wave such as 516 and 518 of FIG. 5 interact with the edge of the antenna illustrated in FIG. 6 they give rise to surface propagating waves 610. These horizontally propagating waves 610 are undesirable because they give rise to surface waves on the aircraft. These surface waves are the creeping waves that propagate around the aircraft and give rise to downward propagating radiation in addition to the downward propagating radiation 612 emanating directly from the antenna.

FIG. 7 illustrates a measured radiation pattern from a typical patch antenna such as the ones illustrated in FIGS. 5 and 6. The geometric construction of FIG. 7 is the same as that of FIG. 6. In other words, radiation indicated propagating upward 608 in FIG. 6 is illustrated propagating upward in the radiation diagram 706 of FIG. 7. The two curves illustrated in FIG. 7 represented the two possible polarizations of radiation. The curve indicated 708 corresponds to right hand circularly polarized (RHCP) radiation and curve indicated by feature 710 illustrates left handed circularly polarized (LHCP) radiation.

As mentioned with regard to FIG. 5, at a typical observation point such as in the direction 706 of FIG. 7, the radiation field results from combining multiple sources. FIG. 5 illustrates just four of these sources, for example, radiation emitted from the edges 508, 510, 512 and 514. In general, there is radiation emanating from all edges of the antenna so the resultant field (e.g., in the direction 706 in FIG. 7) arises from all possible directions emanating from the antenna. Because the antenna radiation includes a number of different waves, the waves interfere constructively and destructively. This constructive and destructive interference generates ripples in the diffraction pattern as indicated in feature 702 in FIG. 7.

Radiation also propagates in downward directions 704. The radiation pattern for this radiation direction 704 also contains a number of ripples and downward facing lobes. Thus, as one measures the radiation in various directions moving around the circle illustrated in FIG. 7, the radiation intensity oscillates between large and small values. These oscillations correspond to the constructive and destructive interference of radiation coming from multiple directions as indicated in FIG. 5. Radiation propagating along the horizontal directions 708 and 710 illustrates that this type of antenna can give rise to surface waves if placed on a conductor such as an aircraft fuselage.

FIG. 8 illustrates the notion of multipath interference. The reciprocity theorem states that if an antenna can radiate in a certain direction it can also receive radiation from that direction. FIG. 7 illustrates that the antenna can radiate and receive from all directions in varying amounts. Thus, an antenna 802 can receive radiation from a GPS satellite along a direct path 804 as well as along various reflected paths. In FIG. 8, several paths are illustrated for radiation being received from a GPS satellite. Features 804, 806 and 808 show waves arriving at the aircraft from a GPS satellite. The wave indicated by 804 interacts directly with the antenna 802 whereas direction 806 indicates a wave that encounters a part of the aircraft 812 and reflects. The reflection is indicated near a tail section 812. This gives rise to a reflective wave that encounters the antenna 802. Likewise, feature 808 indicates radiation arriving at the aircraft from a GPS satellite in such a way that it reflects from a point 810 before encountering the antenna 802. As indicated in FIG. 7 the antenna can receive radiation from multiple directions, and because it can receive these multiple waves from multiple directions, constructive and destructive interference of the signal occurs. This constructive and destructive interference of the signal is illustrated by the ripples in the radiation pattern in FIG. 7.

Disclosed embodiments to be discussed below include antenna system designs having reduced energy radiated and received from downward and horizontal directions. One approach to such systems include the use of ground planes (e.g., 406, 506, and 606 of FIGS. 4-6 respectively) that have been modified to reduce the occurrence of surface waves (e.g., 518 and 610 of FIGS. 5 and 6 respectively).

FIGS. 9A and 9B illustrate the notion of a modified ground plane. In FIGS. 4-6 the ground plane was indicated by features 406, 506, and 606 respectively. In those embodiments the ground plane is a good conductor and serves as one of the two terminals of the antenna. The other terminal being the patch 402, 502 or 602 respectively. As shown in FIGS. 4-6, the fringing fields in the dielectric 408 and 516 gave rise to surface propagating waves illustrated in 610 of FIG. 6. These surface waves in turn were measured as illustrated in FIG. 7 by feature 708 and 710 for the two types of polarization (RHCP and LHCP). The embodiments disclosed in FIGS. 9A and 9B represent an alternative ground plane concept in which the material properties of the ground plane are chosen in order to limit surface waves.

FIG. 9A is an illustration of an antenna 902 configured to radiate in frequencies suitable to GPS communications. The antenna 902 is situated on a ground plane 904 that has high conductivity. Surrounding the high conductivity region 904 is another region 910 having resistivity that increases with distance from the center. This embodiment exhibits reduced surface waves. Surface waves are generated by the antenna 902 and propagate in the conducting region 904. The surface waves continue to propagate in the region 910 but as they encounter increasing resistivity they become damped.

The surface resistivity profile of the ground plane indicated in FIG. 9A is illustrated in FIG. 9B. The first region of high conductivity illustrated by feature 904 in FIG. 9A is illustrated in FIG. 9B as feature 912. This is a region in which the resistivity is low. Feature 914 of FIG. 9B illustrates exponentially increasing resistivity of the ground plane region 910.

The embodiment of 9A has the added advantage that it is constructed of conducting electro-textile fabrics. These fabrics have designable resistivity properties and are lightweight and flexible. As such, they are conformable and can be placed on a curved surface such as that of an aircraft fuselage. In order to properly function on a curved metal surface, however, these embodiments would further be placed on a non-conducting substrate so as to insulate the ground plane from the curved metal surface.

FIGS. 10A and 10B illustrate the performance of the embodiment illustrated in FIG. 9A in comparison with a similar system having a traditional metal ground plane. The antenna 902 illustrated in FIG. 9A was tested in two configurations. In FIG. 10A the antenna was tested on a metal ground plane and in FIG. 10B it was tested on the resistive ground plane illustrated in FIGS. 9A and 9B.

FIG. 10A presents the measured radiation patterns correspond to the two polarization directions 1002 and 1004, with 1002 corresponding to RHCP and 1004 corresponding to LHCP radiation. The measurements of FIGS. 10A and 10B were conducted at 1.5754 GHz which corresponds to the L1 GPS communication frequency. The differences between the performance of the antenna on a metal ground plane as illustrated in FIG. 10A and on the resistive ground plane illustrated in FIG. 10B are revealed by comparing corresponding features. For example, feature 1006 in FIG. 10A is a radiation lobe arising due to interference from multiple sources (e.g., edges 508, 510, 512, and 514 in FIG. 5). The corresponding feature 1020 in FIG. 10B is significantly reduced. The curves in FIG. 10B are also smoother with less ripples. This is due to reduction of radiation (and corresponding constructive and destructive interference) coming from multiple sources. The surface waves of the embodiment of FIG. 10B are reduced compared to the surface waves in a metal ground plane.

The downwardly propagating radiation 1014 in FIG. 10A is reduced by roughly 15 dB and appears as feature 1028 in FIG. 10B. Feature 1010 of FIG. 10A also illustrates another downward propagation radiating direction. With the resistive ground plane of FIG. 10B this feature also is reduced by roughly 10 dB and appears as feature 1024 of FIG. 10B. Feature 1012 of FIG. 10A is a similar backwardly propagating radiation direction. With the resistive ground plane of FIG. 10B this feature also is reduced by more than 10 dB and appears as feature 1026. The conclusion from FIGS. 10A and 10B is that the backwardly propagating radiation from antenna 902 of FIG. 9A is reduced by approximately 10 dB as compared to an antenna on a metal ground plane.

It is interesting to compare feature 1008 however with feature 1022. These features correspond to the horizontally propagating radiation that is generated by surface waves. It can be seen that feature 1022 of FIG. 10B is comparable to 1008 of FIG. 10A. Thus, although the resistive ground plane reduces the backwardly propagating radiation features 1024, 1026 and 1028, the surface propagating waves, 1008 and 1022 are reduced to a lesser extent by the resistive ground plane of FIG. 9A.

FIGS. 11A and 11B illustrate tests of the same two systems as illustrated in FIGS. 10A and 10B, at a different frequency. The tests corresponding to FIGS. 11A and 11B were carried out at 1.227 GHz which corresponds to the L2 GPS communication frequency. The propagation in the forward direction 1102 is comparable to 1116. As with FIGS. 10A and 10B, ripples in the radiation patterns of FIG. 11B with the resistive ground plane are reduced compared to that of the metal ground plane of FIG. 11A. This indicates that a number of the sources of radiation from different edges of the antenna (e.g., edges 508, 510, 512, and 514 in FIG. 5) play a smaller role and therefore there is less constructive and destructive interference.

Radiation propagating in the direction 1114 with an antenna on the metal ground plane is reduced by nearly 10 dB and appears as feature 1128 in FIG. 11B with the use of the resistive ground plane. Likewise, radiation in the downward propagating directions 1110 and 1112 with the metal ground plane are reduced by nearly 10 dB and appear as the corresponding features 1124 and 1126 in FIG. 11B with the use of the resistive ground plane.

The conclusion from FIGS. 11A and 11B is that in addition to the L1 frequency measured in FIGS. 10A and 10B, the L2 frequency measured in FIGS. 11A and 11B also exhibits similar properties in terms of reduced radiation propagated in the downward directions with the use of the resistive ground plane. However, as with the case of FIGS. 10A and 10B radiation propagating horizontally in the form of surface waves is not significantly reduced as can be seen by comparing features 1108 and 1122. Further embodiments discussed below were developed to further reduce radiation propagation in the horizontal as well as downward directions.

FIG. 12 illustrates a further embodiment resistively tapered ground plane. This, in contrast to the embodiment in FIG. 9A, has the resistivity changing in steps. Feature 1202 illustrates the location of a GPS antenna (manufactured, for example, by the EDO Corporation). The innermost section 1204 of the ground plane contains a 7" square conducting electro-textile fabric. This square conducting fabric 1202 is surrounded by other sections of fabric 1206, 1208, 1210, and 1212. Each of these fabrics has a different resistivity, with 1206 having 20 ohms/sq, 1208 having 100 ohms/sq, 1210 have 500 ohms/sq, and 1212 having a 1000 ohms/sq. This gradation of the resistivity provides a stepwise increase in the resistivity from the center of this ground plane to the exterior. This is in contrast to the continuous exponential increase of resistivity of the embodiment of FIG. 9A, as illustrated in the plot of FIG. 9B. The electro-textiles of FIG. 12 are flexible lightweight fabrics that have tunable conducting electrical proprieties. As such, they exhibit desirable radiation properties when used in combination with an antenna 1202, and are lightweight and flexible so that they can be used on a curved surface of an aircraft. The embodiment of FIG. 12 is a 14" step tapered resistive ground plane. In order to properly function on a curved metal surface, however, these embodiments would further be placed on a non-conducting substrate so as to insulate the ground plane from the curved metal surface.

FIGS. 13A and 13B compare the 14" resistive step graded ground plane of FIG. 12 with the continuously graded resistive ground plane of FIG. 9A. FIG. 13A shows the radiation pattern of the continuously graded resistivity embodiment of FIG. 9A and FIG. 13B shows that of the 14" step graded resistive textile ground plane of embodiment FIG. 12. The radiation patterns of these systems were measure at 1.227 GHz, which is the L2 GPS communication band. Comparison of FIGS. 13A and 13B is facilitated by comparing corresponding features as was done with regard to FIGS. 10A, 10B, 11A, and 11B.

The performance of the two systems illustrated in FIGS. 13A and 13B is similar. Both measured radiation pattern show similar shapes as indicated by comparing features 1302 with 1316, comparing 1306 with 1320, etc. Most of the ripples illustrated in FIGS. 10A and 11A corresponding to metal ground planes have been smoothed in both resistive ground planes of FIGS. 13A and 13B. The radiation in the forward directions 1302 and 1316 are comparable. Likewise the features 1304 and 1318 are also comparable. Likewise similar performance for surface waves can be seen in 1308 and 1322.

FIG. 13A outperforms FIG. 13B, however, in terms of downward propagating radiation. For example, feature 1314 corresponding to downward propagating radiation is roughly 10 dB smaller in FIG. 13A than is the corresponding feature 1328 in FIG. 13B. This shows that the 26" ground plane with continuously varying resistivity illustrated in FIGS. 9A and 9B outperforms the 14" step graded embodiment illustrated in FIG. 12 with regard to downwardly propagating radiation.

The embodiments presented above can also be compared in terms of their performance with respect to multi-path interference. FIG. 14 illustrates the concept of multi-path interference and provides a definition for the "multi-path ratio" which is used to judge the performance of various embodiments.

The concept of multi-path interference was first introduced in FIG. 8. In that context a GPS satellite was seen to receive signals along a number of different paths giving rise to constructive and destructive interference of the received signal. In FIG. 14 an antenna 1402 receives a signal from a satellite 1410. The signal can be received along a direct path 1412 as well as along an alternate path 1416 after a reflection from a ground plane 1414 (or other object such as an aircraft fuselage). The two paths interfere and give rise to ripples in the radiation pattern (e.g., as seen in FIG. 7). The multi-path ratio is defined by comparing the direct radiated signal 1412 with that received from various reflections 1416 and is defined by equation 1420 in FIG. 14.

This is the ratio of the radiation of the principle polarization in the upper hemisphere (e.g., received primarily from a satellite) to the radiation from both polarizations in the lower hemisphere (e.g., where multi-path and interference signals are most prevalent). In this example, the primary polarization of the radiation coming from the satellite is assumed to be RHCP.

This component 1412 (incident at angle θ 1408) is in the numerator of the multi-path ratio 1420. The denominator of the multi-path ratio contains the total signal for both polarizations (incident at angle 180°−θ) from below the antenna. The reflected radiation contains both polarizations because a signal changes polarization when it is reflected. Therefore, the signals received from below the horizon generally have both polarizations due to one or more reflections from the ground plane.

FIG. 15 is a computed multi-path ratio for the systems illustrated in FIGS. 9A and 12. The horizontal axis of the plot in FIG. 15 illustrates the angle measured from directly upward. The zero on the x-axis of FIG. 15 corresponds to receiving signals from directly above and directly below the antenna (i.e., with θ=0 in 1420). Thus, if the source of radiation, such as a GPS satellite was directly above the antenna, the values on the vertical axis is the multi-path ratio 1420 evaluated for that situation.

Curves 1506 and 1504 correspond to the systems of FIGS. 12 and 9A, respectively. An antenna system is judged to be better performing the lower the value of the multi-path ratio.

Feature 1506 is consistently below feature 1504. This shows that 14" square resistivity tapered textile ground plane illustrated in FIG. 12 outperforms the 26" resistivity tapered ground plane of FIG. 9A in terms of the multi-path ratio. FIG. 15 thus illustrates the importance of considering several metrics when evaluating an antenna system.

In terms of multi-path ratio, the 14" square resistivity tapered ground plane outperforms the 26" ground plane in terms of the multi-path ratio. This is in contrast to the performance observed in the corresponding test of FIGS. 13A and 13B, wherein the 26" ground plane outperformed the 14" ground plane in terms of radiation propagating in a downward direction.

FIG. 16 illustrates a further embodiment resistive step tapered ground plane having circular shaped electronic textile components. Each of the materials 1602, 1606, 1610, 1614, and 1618, has a different resistivity. The innermost layer 1602 has an 18" diameter 1604 and virtually no resistivity. The next layer, having a 20.5" diameter, has a resistivity of 20 ohm/sq. The remaining layers 1610, 1614, and 1618 have resistivities 100 ohm/sq, 500 ohm/sq, and 1000 ohm/sq, respectively. These layers have increasing diameters 22.4", 24", and 25" diameters, respectively. This embodiment having circular geometry is designed to reduce diffraction effects in comparison to comparable systems having corners (e.g., the square ground plane of FIG. 12).

FIGS. 17A-17D, illustrate further embodiments designed to reduce surface wave propagation. FIG. 17A, for example, is a ground plane having a collection of periodically spaced rectangular features 1706 residing on a dielectric substrate 1702. Each of these rectangular patches has a resistive border 1704 with a conductive center patch 1706. All embodiments are all constructed using electro-textiles. As in previous examples, these embodiments are lightweight and flexible and can be placed on a curved surface of a cylinder, such as the surface of an aircraft.

The embodiment of FIG. 17A is an artificial magnetic conductor, (also called a frequency selective surface). This system exhibits a large impedance to the propagation of surface waves. As such, this embodiment is designed to suppress diffraction effects that can degrade antenna patterns. This embodiment acts an electronic band gap material having a stop band in a particular part of the spectrum. For example, an embodiment such as FIG. 17A is designed to have a stop band somewhere in the range of 1.1 to 1.6 GHz (i.e., within the frequency band used for GPS communications).

FIG. 17 B shows a further embodiment electronic band gap ground plane material. This figure illustrates a dielectric substrate 1708 having conductive patches 1710 contained thereon. In addition, each of the conducting patches is connected by resistive segments 1712. As in the embodiment of FIG. 17A, the embodiment of 17B is also constructed from electro-textiles. As such, it is flexible and lightweight and can be placed on a circular cylindrical surface of an aircraft.

FIG. 17C shows a further embodiment electronic band gap ground plane that is similar to the embodiment illustrated in FIG. 17A. This embodiment has a dielectric substrate 1714, conducting patches 1720, and resistive electro-textile borders 1718. These features are all similar to the features of 17A. In addition to the features of 17A, the embodiment of 17C also contains conducting metal pins 1716. The conducting metal pins 1716 connect the outer conducting surface 1720 to the dielectric substrate 1714 and can also make contact with an electrical conducting surface underneath, such as the surface of a cylinder or metallic surface of an aircraft.

Figure 17D:
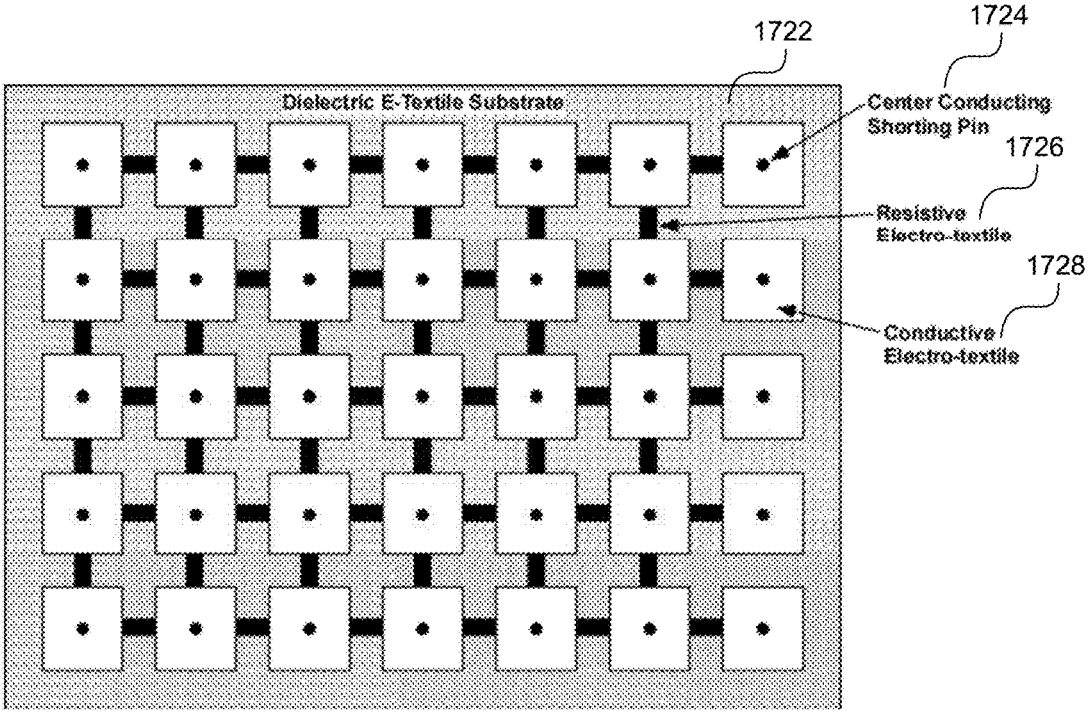

FIG. 17D illustrates a further embodiment electronic band gap ground plane that is similar to the embodiment of FIG. 17B. As in FIG. 17B, a dielectric substrate 1722 is illustrated. Also illustrated is a periodic array of conductive patches 1728 residing on the dielectric substrate 1722. Also, similar to FIG. 17B are resistive connecting portions 1726. Unlike the embodiments in 17B however, the embodiment of 17D also includes conducting pins 1724, that provide an electrical conduction path between the conductive patches 1728 and the dielectric substrate below. They may also connect the conducting patches 1728 to an electrical conductor underneath the system, such as a cylindrical surface or the surface of an aircraft.

FIG. 18 illustrates an electronic band gap ground plane similar to FIG. 17C that was constructed and tested. A GPS antenna 1802 is also illustrated (manufactured by the EDO Corporation). The center conducting pins 1716 of FIG. 17C are illustrated in FIG. 18 as feature 1804. The system of FIG. 18 is a 14" square electronic band gap ground plane that is designed to suppress surface waves. The electronic band gap ground plane of FIG. 18 is constructed of flexible electro-textiles. As, such it has desirable electromagnetic properties, but is also lightweight and flexible and can be used on a curved surface of a cylinder such as the surface of an aircraft.

FIG. 19 illustrates schematically how a system such as that depicted in FIG. 18 would be implemented on a cylindrical surface, such as the surface of an aircraft. As can be seen in FIG. 19, the system illustrated in FIG. 18 would reside on a cylinder 1902.

The antenna 1904 is contrasted with 1802 of FIG. 18. This particular antenna 1902 has a circular or elliptical shape, and functions as a reduced surface wave (RSW) antenna. It is also made of electro-textiles as described in further detail below. The antenna 1904 is placed on an electronic band gap ground plane 1906, similar to the one illustrated in FIG. 18 and embodiments illustrated in FIGS. 17A-17D.

This RSW antenna structure 1904 is a specially designed, stacked, dual-band circular shape antenna that is made of electro-textiles. The outer radius 1912 of these stacked circular patches has been adjusted to reduce the creeping waves from propagating in the surface of the aircraft. The resonance frequency of antenna 1904 in the two frequency bands of interest is obtained by optimizing the inner surface radii 1908. The inner circumferential surfaces of the top and bottom patches that make up antenna 1904 are directly connected to the bottom ground plane 1908, which in this case is the surface of the aircraft.

GPS antennas are designed to emit circularly polarized radiation. The top and bottom patches of the antenna are feed by a set of four coaxial probes that are connected to a polarizing feed network to generate the required circular polarization (RHCP). As discussed previously, the electronic ground plane 1906 is designed as a band stop filter to reduce surface waves flowing on the surface of the cylinder.

In an embodiment, the antenna 1904 is dual band stacked antenna. It includes a stack of patches having five separate stacked layers. The top layer is annular and is a conducing ring-shaped patch residing on a dielectric substrate. It is designed to resonate in the GPS L1 band. The second layer is the dielectric substrate for this top patch antenna. The third layer is another annular ring conducting patch tuned to resonate at either the GPS L2 or the GPS L5 band. Its size is larger than that of the patch of the first layer, so it operates at a lower frequency. The fourth layer is dielectric substrate for the lower patch antenna. The last and fifth layer is the conducting ground plane. For a GPS antenna on an aircraft, the ground plane is the fuselage of the aircraft. One feature of this design is that the inner circumferential surfaces of both the top and bottom patches are connected to the ground plane which in this case is the fuselage of the aircraft.

Such a reduced surface wave antenna 1904 is chosen to be either circular or elliptical in configuration and is placed on top of the electronic band gap ground plane 1906. All of these materials 1906 and 1904 are made from electro-textiles. A circular shape is used when the size of the aircraft fuselage is large in diameter. In such an instance, the radius of curvature of the cylindrical shape fuselage is much greater than the diameter of the circular patch antenna. Such a situation ensures that there is not much bending of the circular patch and that the antenna is nearly flat on the top surface of the aircraft. Any bending from the planer configuration can degrade the antenna performance. If the aircraft fuselage is a thin cylinder, an elliptical shape RSW antenna is used. The major axis of the ellipse can be aligned parallel to the longitudinal axis of the fuselage (i.e., along the axis of the cylinder). The minor axis can be orthogonal to the axis to the cylinder. Such a situation with an elliptical antenna is depicted in FIG. 19 as feature 1904.

The system illustrated in FIG. 18 and schematically illustrated in FIG. 19 was tested as illustrated in FIGS. 20A and 20B. FIG. 20A illustrates the situation in which an antenna 2004 is placed on a bare metal cylinder. In contrast, FIG. 20B illustrates the situation in which the same antenna 2004 is placed on an electric band gap material, such as illustrated in FIG. 18. The systems illustrated in FIGS. 20A and 20B were measured and will be discussed in further detail below in FIGS. 21A and 21B. FIG. 20C illustrates the geometry corresponding to FIGS. 21A and 21B.

In FIG. 20C, the system with the antenna 2010 and the electronic band gap material 2012 is situated on a cylinder 2008 such that the cylinder is viewed along its axis. In other words, the axis of the cylinder in FIG. 20C comes out of plane of the figure. In this illustration the antenna orientation has been chosen to be placed on top of the cylinder with the surrounding electronic band gap material draped across the cylinder on the top as illustrated in feature 2012.

The measured radiation patterns of the antenna system having the RSW antenna on an electronic band gap material 2012 is compared with corresponding measurements of a conventional GPS antenna on a bare metal cylinder in FIGS. 21A and 21B. FIG. 21A illustrates the measured radiation pattern 2102 of a conventional GPS antenna on an electronic band gap material in comparison with the radiation pattern 2104 of the same antenna on a metal cylinder.

There is roughly a 10 dB reduction in backward propagating radiation as can be seen by comparing features 2010 for the bare metal cylinder with feature 2112 for the result of the same antenna on electronic band gap material. Also by comparing features 2106 and 2108 a reduction in radiation in the horizontal direction by nearly 10 dB is observed. Feature 2106 corresponds to horizontal radiation when the antenna is placed on the bare metal cylinder. Feature 2108 corresponds to horizontal radiation when the antenna is placed on the electronic band gap material. The conclusion from FIG. 21A is that the electronic band gap material illustrated in FIGS. 17A-17D and FIG. 18 indeed reduces the surface waves and thus reduces radiation propagating downward and in the horizontal directions.

FIG. 21B illustrates the measured radiation patterns of the RSW antenna (discussed as feature 1904 in FIG. 19) on the electronic band gap material in comparison with the same antenna on a bare metal cylinder.

In the first situation 2114, the antenna is placed on a bare metal cylinder. The curve 2116 illustrates the situation in which the same antenna is placed on the electronic band gap material. The radiation propagating downward is significantly reduced in this situation as can be seen by comparing feature 2118 with feature 2120. The downward radiation 2120 that occurs when the RWS antenna is placed on the electronic band gap material is reduced by nearly 10 dB as compared with the corresponding radiation 2118 that occurs when the RWS antenna is placed on a bare metal cylinder. In addition it should be noted that the radiation on the horizontal axis in FIG. 21B in both situations is smaller than both situations in FIG. 21A by nearly 10 dB.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An antenna system, comprising:

a reduced surface wave antenna configured to operate in at least a frequency range between 1.1-1.6 GHz; and a ground plane comprising a plurality of electro-textiles configured to operate as a frequency selective surface with electronic band gap characteristics to suppress edge and curved surface diffraction effects, wherein the reduced surface wave antenna and the ground plane are configured to be mounted on a cylindrical conductor, and further wherein the reduced surface wave antenna and the ground plane work in conjunction to reduce at least one of a Multipath Ratio and a Front-to-Back Ratio.

2. The system of claim 1, wherein the reduced surface wave antenna is an annular ring micro-strip patch antenna.

3. The system of claim 1, wherein the reduced surface wave antenna is an annular ring micro-strip patch antenna having an annular ring of elliptical shape.

4. The system of claim 1, wherein the ground plane further comprises a periodic array of resonant structures on top of a dielectric substrate.

5. The system of claim 4, wherein the resonant structures comprise conducting patches made from conducting electro-textiles.

6. The system of claim 1, wherein the reduced surface wave antenna is further configured to radiate in at least one of $L_1$, $L_2$, and $L_5$ frequency bands.

7. The system of claim 1, wherein the reduced surface wave antenna and the ground plane are further configured to radiate with attenuated surface waves.

8. The system of claim 1, wherein the reduced surface wave antenna and the ground plane are further configured to be mounted on an aircraft and to operate as a communication system.

9. The system of claim 8, wherein the reduced surface wave antenna and the ground plane are further configured to suppress multi-path and co-site interference from other antennas on the aircraft.

10. The system of claim 8, wherein the reduced surface wave antenna and the ground plane are further configured to reject signals from ground based sources or sources on other aircraft.

11. A ground plane for an antenna comprising:

a plurality of electro-textiles configured to operate as a frequency selective surface with electronic band gap characteristics to suppress edge and curved surface diffraction effects, wherein the ground plane and the antenna are configured to be mounted on a cylindrical conductor, and further wherein the antenna and the ground plane work in conjunction to reduce at least one of a Multipath Ratio and a Front-to-Back Ratio.

12. The ground plane of claim 11, wherein the ground plane is further configured to exhibit electronic band gap characteristics in at least one of $L_1$, $L_2$, and $L_5$ frequency bands.

13. The ground plane of claim 11, wherein the Multipath Ratio is based on comparing at least one direct signal received along a direct path between the antenna and a satellite to at least one reflected signal received along an alternate path between the antenna and the satellite.

14. The ground plane of claim 11, wherein the ground plane is further configured to exhibit electronic band gap characteristics over a frequency range between 1.1-1.6 GHz.

15. The ground plane of claim 11, wherein the ground plane is further configured to be mounted on a cylindrical conductor.

16. The ground plane of claim 11, wherein the plurality of electro-textiles further comprise a periodic array of resonant structures on top of a dielectric substrate.

17. The ground plane of claim 16, wherein the resonant structures comprise conducting patches made from conducting electro-textiles.

18. The ground plane of claim 17, further comprising a layer comprising at least one layer of non-conducting textiles that act as a dielectric substrate.

19. The ground plane of claim 11, further comprising:

a first two-dimensional layer having a periodic array of conducting patches made from conducting electro-textiles;

a second layer comprising at least one layer of non-conducting textiles that act as a dielectric substrate; and a third highly-conducting layer made from conduction textiles, wherein the second layer is sandwiched between the first and third layers and each conducting patch further comprises a conducting via connecting the conducting patch to the third highly conducting layer.

20. The ground plane of claim 19, wherein the ground plane is further configured to exhibit electronic band gap characteristics in at least one of $L_1$, $L_2$, and $L_5$ frequency bands.

* * * * *